US009706328B2

(12) United States Patent
Suyama et al.

(10) Patent No.: US 9,706,328 B2
(45) Date of Patent: Jul. 11, 2017

(54) PROGRAM USED FOR TERMINAL APPARATUS, SOUND APPARATUS, SOUND SYSTEM, AND METHOD USED FOR SOUND APPARATUS

(71) Applicant: Yamaha Corporation, Hamamatsu-shi, Shizuoka (JP)

(72) Inventors: Akihiko Suyama, Hamamatsu (JP); Ryotaro Aoki, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 14/894,410

(22) PCT Filed: May 27, 2014

(86) PCT No.: PCT/JP2014/063974
§ 371 (c)(1),
(2) Date: Nov. 27, 2015

(87) PCT Pub. No.: WO2014/192744
PCT Pub. Date: Dec. 4, 2014

(65) Prior Publication Data

US 2016/0127849 A1 May 5, 2016

(30) Foreign Application Priority Data

May 30, 2013 (JP) ..... 2013-113741

(51) Int. Cl.
*H04S 7/00* (2006.01)
*H04S 5/00* (2006.01)

(52) U.S. Cl.
CPC ..... *H04S 7/303* (2013.01); *H04S 5/005* (2013.01); *H04S 2400/11* (2013.01)

(58) Field of Classification Search
CPC ..... H04S 7/303; H04S 5/005; H04S 2400/11
(Continued)

(56) References Cited

U.S. PATENT DOCUMENTS 5,784,467 A 7/1998 Asayama
2002/0166439 A1 11/2002 Nishitani et al.
(Continued)

FOREIGN PATENT DOCUMENTS

EP 2 922 313 A1 9/2015
JP 8-272380 A 10/1996
(Continued)

OTHER PUBLICATIONS

International Search Report (PCT/ISA/210) issued in PCT Application No. PCT/JP2014/063974 dated Jul. 8, 2014, with English translation (four (4) pages).
(Continued)

*Primary Examiner* — David Ton
(74) *Attorney, Agent, or Firm* — Crowell & Moring LLP

(57) ABSTRACT

A sound apparatus includes: an acceptance unit that accepts an input of an input audio signal from outside; a communication unit that accepts from a terminal apparatus first direction information indicating a first direction, the first direction being a direction in which a virtual sound source is arranged; a position information generation unit that generates virtual sound source position information based on listening position information, the first direction information and boundary information, the listening position information indicating a listening position, the boundary information indicating a boundary of a space where the virtual sound source is arranged, the virtual sound source position information indicating a position of the virtual sound source on the boundary; a signal generation unit that imparts, based on loudspeaker position information, the listening position information and the virtual sound source position information, a sound effect to the input audio signal such that a sound is heard at the listening position as if the sound comes from the virtual sound source, to generate an output audio
(Continued)

signal, the loudspeaker position information indicating positions of a plurality of loudspeakers; and an output unit that outputs the output audio signal to outside.

14 Claims, 17 Drawing Sheets

(58) Field of Classification Search
USPC ..... 381/17, 18, 303, 310
See application file for complete search history.

(56) References Cited

U.S. PATENT DOCUMENTS

2007/0274528 A1 11/2007 Nakamoto et al.
2012/0075957 A1* 3/2012 De Bruijn ..... H04S 7/301 367/118
2012/0113224 A1* 5/2012 Nguyen ..... G06T 7/0065 348/46
2014/0169569 A1* 6/2014 Toivanen ..... H04R 5/04 381/17

FOREIGN PATENT DOCUMENTS

JP 2000-354300 A 12/2000
JP 2002-341865 A 11/2002
JP 2006-74589 A 3/2006
JP 2012-529213 A 11/2012
WO WO 2010/140088 A1 12/2010

OTHER PUBLICATIONS

Japanese-language Written Opinion (PCT/ISA/237) issued in PCT Application No. PCT/JP2014/063974 dated Jul. 8, 2014 (four (4) pages).
Extended European Search Report issued in counterpart European Application No. 14803733.6 dated Apr. 28, 2017 (8 pages).

* cited by examiner

PROGRAM USED FOR TERMINAL APPARATUS, SOUND APPARATUS, SOUND SYSTEM, AND METHOD USED FOR SOUND APPARATUS

TECHNICAL FIELD

The present invention relates to a technique for designating a position of a virtual sound source.

Priority is claimed on Japanese Patent Application No. 2013-113741 filed on May 30, 2013, the content of which is incorporated herein by reference.

BACKGROUND ART

A sound apparatus that forms a sound field by a synthetic sound image by using a plurality of loudspeakers has been known. For example, there is an audio source in which multi-channel audio signals such as 5.1 channels are recorded, such as a DVD (Digital Versatile Disc). A sound system that reproduces such an audio source has been widely used even in general households. In reproduction of the multi-channel audio source, if each loudspeaker is arranged at a recommended position in a listening room and a user listens at a preset reference position, a sound reproduction effect such as a surround effect can be acquired.

The sound reproduction effect is based on the premise that a plurality of loudspeakers are arranged at recommended positions, and the user listens at a reference position. Therefore, if the user listens at a position different from the reference position, the desired sound reproduction effect cannot be acquired. Patent Document 1 discloses a technique of correcting an audio signal so that a desired sound effect can be acquired, based on position information of a position where the user listens.

PRIOR ART DOCUMENT

Patent Document

[Patent Document 1] Japanese Unexamined Patent Application, First Publication No. 2000-354300

SUMMARY OF THE INVENTION

Problem to be Solved by the Invention

There are cases where it is desired to realize such a sound effect where a sound image is localized at a position desired by a user. However, a technique of designating the position of the virtual sound source by the user at the listening position has not been proposed heretofore.

The present invention has been conceived in view of the above situation. An exemplary object of the present invention is to enable a user to easily designate a position of a virtual sound source at a listening position.

Means for Solving the Problem

A program according to an aspect of the present invention is for a terminal apparatus, the terminal apparatus including an input unit, a direction sensor, a communication unit and a processor, the input unit accepting from a user an instruction in a state with the terminal apparatus being arranged at a listening position, the instruction indicating that the terminal apparatus is oriented toward a first direction, the first direction being a direction in which a virtual sound source is arranged, the direction sensor detecting a direction in which the terminal apparatus is oriented, the communication unit performing communication with a sound apparatus. The program causes the processor to execute: acquiring from the direction sensor first direction information indicating the first direction, in response to the input unit accepting the instruction; generating virtual sound source position information based on listening position information, the first direction information and boundary information, the listening position information indicating the listening position, the boundary information indicating a boundary of a space where the virtual sound source is arranged, the virtual sound source position information indicating a position of the virtual sound source on the boundary; and transmitting the virtual sound source position information to the sound apparatus, by using the communication unit.

According to the program described above, the virtual sound source position information indicating the position of the virtual sound source on the boundary of the space can be transmitted to the sound apparatus, by only operating the terminal apparatus toward the direction in which the virtual sound source is arranged, at the listening position.

A sound apparatus according to an aspect of the present invention includes: an acceptance unit that accepts an input of an input audio signal from outside; a communication unit that accepts from a terminal apparatus first direction information indicating a first direction, the first direction being a direction in which a virtual sound source is arranged; a position information generation unit that generates virtual sound source position information based on listening position information, the first direction information and boundary information, the listening position information indicating a listening position, the boundary information indicating a boundary of a space where the virtual sound source is arranged, the virtual sound source position information indicating a position of the virtual sound source on the boundary; a signal generation unit that imparts, based on loudspeaker position information, the listening position information and the virtual sound source position information, a sound effect to the input audio signal such that a sound is heard at the listening position as if the sound comes from the virtual sound source, to generate an output audio signal, the loudspeaker position information indicating positions of a plurality of loudspeakers; and an output unit that outputs the output audio signal to outside.

The sound apparatus described above generates the virtual sound source position information based on the first direction information accepted from the terminal apparatus. Moreover, the sound apparatus imparts a sound effect to the input audio signal such that a sound is heard at the listening position as if the sound comes from the virtual sound source, based on the loudspeaker position information, the listening position information, and the virtual sound source position information, to generate the output audio signal. Accordingly, the user can listen to the sound of the virtual sound source from a desired direction at an arbitrary position in a listening room, for example.

A sound system according to an aspect of the present invention includes a sound apparatus and a terminal apparatus.

The terminal apparatus includes: an input unit that accepts from a user an instruction in a state with the terminal apparatus being arranged at a listening position, the instruction indicating that the terminal apparatus is oriented toward a first direction, the first direction being a direction in which a virtual sound source is arranged; a direction sensor that detects a direction in which the terminal apparatus is oriented; an acquisition unit that acquires from the direction sensor first direction information indicating the first direction, in response to the input unit accepting the instruction; a position information generation unit that generates virtual sound source position information based on listening position information, the first direction information and boundary information, the listening position information indicating the listening position, the boundary information indicating a boundary of a space where the virtual sound source is arranged, the virtual sound source position information indicating a position of the virtual sound source on the boundary; and a first communication unit that transmits the virtual sound source position information to the sound apparatus.

The sound apparatus includes: an acceptance unit that accepts an input of an input audio signal from outside; a second communication unit that accepts the virtual sound source position information from the terminal apparatus; a signal generation unit that imparts, based on loudspeaker position information, the listening position information and the virtual sound source position information, a sound effect to the input audio signal such that a sound is heard at the listening position as if the sound comes from the virtual sound source, to generate an output audio signal, the loudspeaker position information indicating positions of a plurality of loudspeakers; and an output unit that outputs the output audio signal to outside.

According to the sound system described above, by only operating at the listening position the terminal apparatus toward the first direction indicating the direction in which the virtual sound source is arranged, the first direction information indicating the first direction can be transmitted to the sound apparatus. The sound apparatus generates the virtual sound source position information based on the first direction information. Moreover, the sound apparatus imparts a sound effect to the input audio signal such that a sound is heard at the listening position as if the sound comes from the virtual sound source, based on the loudspeaker position information, the listening position information, and the virtual sound source position information, to generate the output audio signal. Accordingly, the user can listen to the sound of the virtual sound source from a desired direction, at an arbitrary position in the listening room, for example.

A method for a sound apparatus according to an aspect of the present invention includes: accepting an input of an input audio signal from outside; accepting from a terminal apparatus first direction information indicating a first direction, the first direction being a direction in which a virtual sound source is arranged; generating virtual sound source position information based on listening position information, the first direction information and boundary information, the listening position information indicating a listening position, the boundary information indicating a boundary of a space where the virtual sound source is arranged, the virtual sound source position information indicating a position of the virtual sound source on the boundary; imparting, based on loudspeaker position information, the listening position information and the virtual sound source position information, a sound effect to the input audio signal such that a sound is heard at the listening position as if the sound comes from the virtual sound source, to generate an output audio signal, the loudspeaker position information indicating positions of a plurality of loudspeakers; and outputting the output audio signal to outside.

EMBODIMENTS FOR CARRYING OUT THE INVENTION

Hereunder, embodiments of the present invention will be described with reference to the drawings.

<Configuration of the Sound System>

Figure 1:
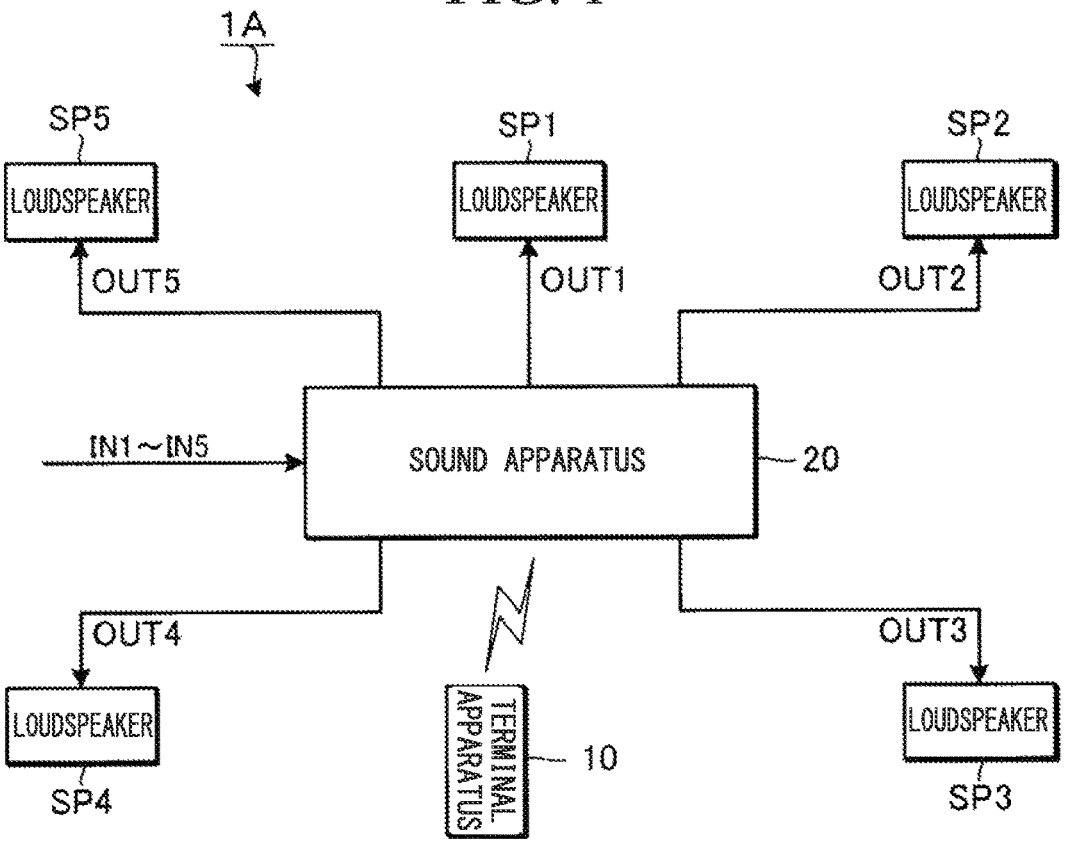
FIG. 1 is a block diagram showing a configuration example of a sound system according to an embodiment of the present invention.

FIG. 1 shows a configuration example of a sound system 1A according to a first embodiment of the present invention. The sound system 1A includes a terminal apparatus 10, a sound apparatus 20, and a plurality of loudspeakers SP1 to SP5. The terminal apparatus 10 may be a communication device such as a smartphone, for example. The terminal apparatus 10 is communicable with the sound apparatus 20. The terminal apparatus 10 and the sound apparatus 20 may perform communication by wireless or by cable. For example, the terminal apparatus 10 and the sound apparatus 20 may communicate via a wireless LAN (Local Area Network). The terminal apparatus 10 can download an application program from a predetermined site on the Internet. A specific example of the application program may include a program to be used for designating a position of a virtual sound source, a program to be used for measuring an arrangement direction of the respective loudspeakers SP1 to SP5, and a program to be used for specifying a position of a user A.

The sound apparatus 20 may be a so-called multichannel amplifier. The sound apparatus 20 generates output audio signals OUT1 to OUT5 by imparting sound effects to input audio signals IN1 to IN5, and supplies the output audio signals OUT1 to OUT5 to the loudspeakers SP1 to SP5. The loudspeakers SP1 to SP5 are connected to the sound apparatus 20 by wireless or by cable.

Figure 2:
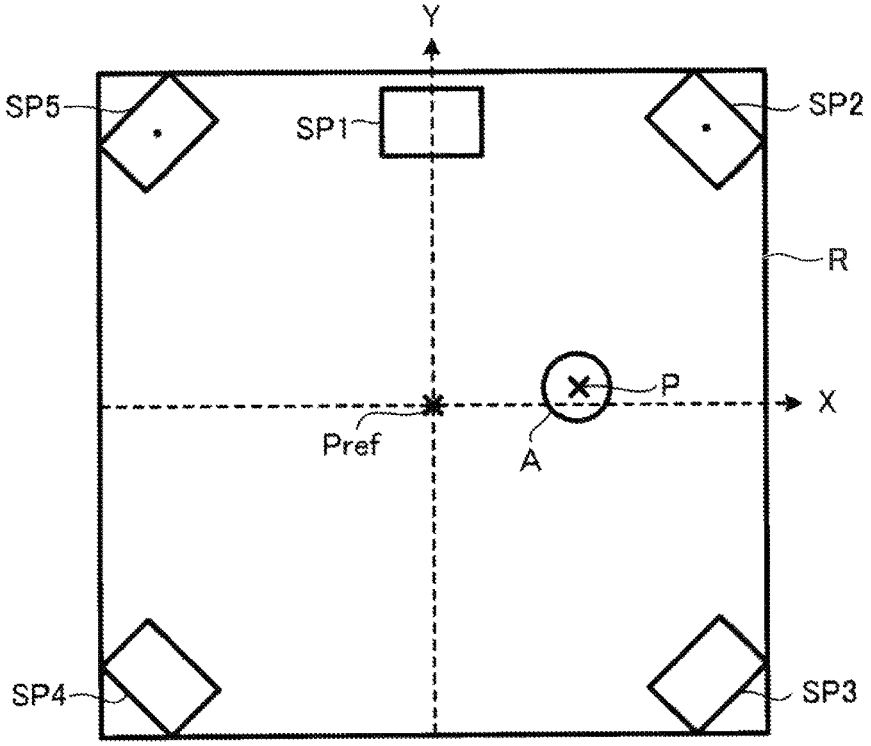
FIG. 2 is a plan view showing an arrangement of loudspeakers, a reference position, and a listening position in a listening room in the embodiment of the present invention.

FIG. 2 shows an arrangement example of the loudspeakers SP1 to SP5 in a listening room R of the sound system 1A. In this example, 5 loudspeakers SP1 to SP5 are arranged in the listening room R. However, the number of loudspeakers is not limited to 5, and may be 4 or less or 6 or more. In this case, the number of input audio signals may be 4 or less or 6 or more. For example, the sound system 1A may be a so-called 5.1 surround system including a subwoofer loudspeaker.

Hereunder, description will be given based on the assumption that loudspeaker position information indicating respective positions of the loudspeakers SP1 to SP5 in the listening room R in the sound system 1A has been known. In the sound system 1A, when the user A listens to the sound emitted from the loudspeakers SP1 to SP5 at a preset position (hereinafter, referred to as "reference position") Pref, a desired sound effect can be acquired. In this example, the loudspeaker SP1 is arranged at the front of the reference position Pref. The loudspeaker SP2 is arranged diagonally right forward of the reference position Pref. The loudspeaker SP3 is arranged diagonally right rearward of the reference position Pref. The loudspeaker SP4 is arranged diagonally left rearward of the reference position Pref. The loudspeaker SP5 is arranged diagonally left forward of the reference position Pref.

Moreover, hereunder, description will be given based on the assumption that the user A listens to the sound at a listening position (predetermined position) P, different from the reference position Pref. Furthermore, hereunder, description will be given based on the assumption that listening position information indicating the position of the listening position P has been known. The loudspeaker position information and the listening position information are given, for example, in an XY coordinate with the reference position Pref as the origin.

Figure 3:
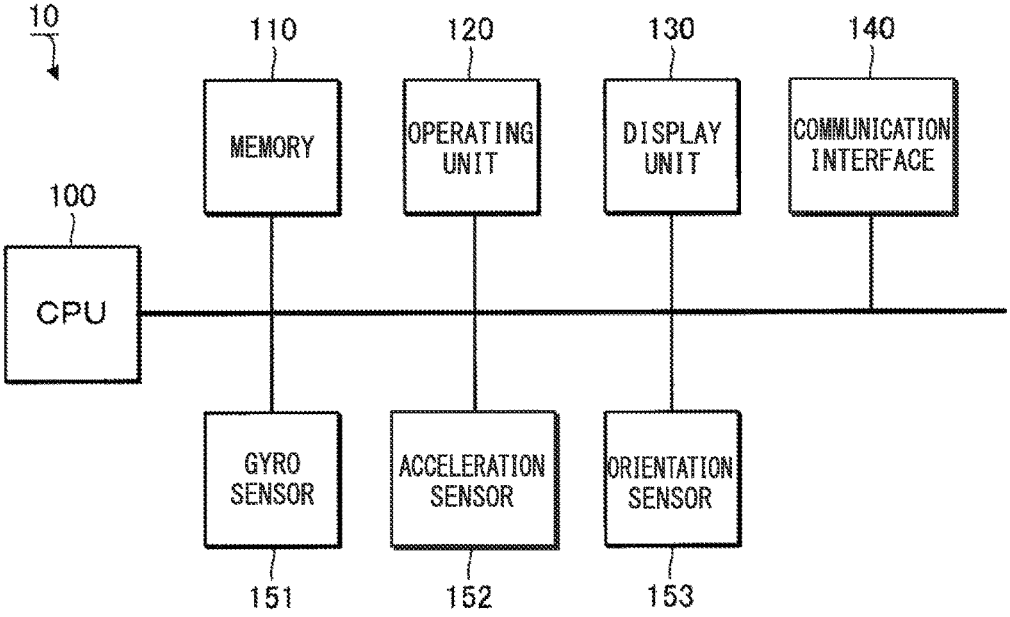
FIG. 3 is a block diagram showing an example of a hardware configuration of a terminal apparatus according to the present embodiment.

FIG. 3 shows an example of a hardware configuration of the terminal apparatus 10. In the example shown in FIG. 3, the terminal apparatus 10 includes a CPU 100, a memory 110, an operating unit 120, a display unit 130, a communication interface 140, a gyro sensor 151, an acceleration sensor 152, and an orientation sensor 153. The CPU 100 functions as a control center of the entire device. The memory 110 memorizes an application program and the like, and functions as a work area of the CPU 100. The operating unit 120 accepts an input of an instruction from a user. The display unit 130 displays operation contents and the like. The communication interface 140 performs communication with the outside.

Figure 4:
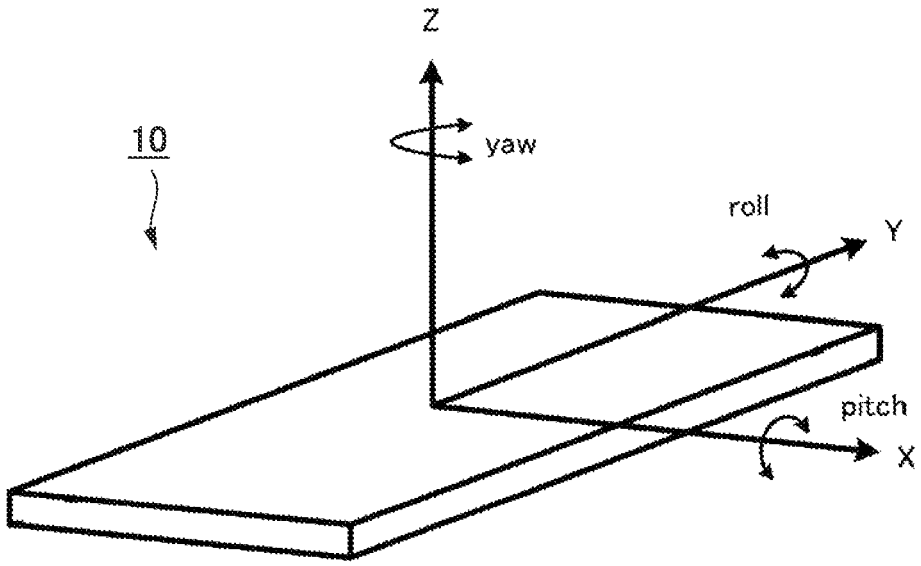
FIG. 4 is a diagram for explaining an angle measured by a gyro sensor according to the present embodiment.

In the example shown in FIG. 4, the X axis corresponds to a width direction of the terminal apparatus 10. The Y axis corresponds to a height direction of the terminal apparatus 10. The Z axis corresponds to a thickness direction of the terminal apparatus 10. The X axis, the Y axis, and the Z axis are orthogonal to each other. A pitch angle (pitch), a roll angle (roll), and a yaw angle (yaw) are respectively rotation angles around the X axis, the Y axis, and the Z axis. The gyro sensor 151 detects and outputs the pitch angle, the roll angle, and the yaw angle of the terminal apparatus 10. A direction in which the terminal apparatus 10 faces can be specified based on these rotation angles. The acceleration sensor 152 measures an X-axis, a Y-axis, and a Z-axis direction component of acceleration applied to the terminal apparatus 10. In this case, acceleration measured by the acceleration sensor 152 is represented by three-dimensional vectors. The direction in which the terminal apparatus 10 faces can be specified based on the three-dimensional vectors. The orientation sensor 153 detects, for example, geomagnetism to thereby measure the orientation in which the orientation sensor 153 faces. The direction in which the terminal apparatus 10 faces can be specified based on the measured orientation. Signals output by the gyro sensor 151 and the acceleration sensor 152 are in a triaxial coordinate system provided in the terminal apparatus 10, and are not in a coordinate system fixed to the listening room. As a result, the direction measured by the gyro sensor 151 and the acceleration sensor 152 is relative orientation. That is to say, when the gyro sensor 151 or the acceleration sensor 152 is used, an arbitrary object (target) fixed in the listening room R is used as a reference, and an angle with respect to the reference is acquired as a relative direction. On the other hand, the signal output by the orientation sensor 153 is the orientation on the earth, and indicates an absolute direction.

The CPU 100 executes the application program to measure the direction in which the terminal apparatus 10 faces by using at least one of the outputs of the gyro sensor 151, the acceleration sensor 152, and the orientation sensor 153. In the example shown in FIG. 3, the terminal apparatus 10 includes the gyro sensor 151, the acceleration sensor 152, and the orientation sensor 153. However, it is not limited to such a configuration. The terminal apparatus 10 may include only one of the gyro sensor 151, the acceleration sensor 152, and the orientation sensor 153. The gyro sensor 151 and the acceleration sensor 152 output angles. The angle is indicated by a value with respect to an arbitrary reference. The object to be the reference may be selected arbitrarily from objects in the listening room R. As a specific example, a case where a loudspeaker whose direction is measured first, of the loudspeakers SP1 to SP5, is selected as the object, will be described later.

On the other hand, in the case where the directions of the loudspeakers SP1 to SP5 are measured by using the orientation sensor 153, an input of the reference direction is not required. The reason for this is that the orientation sensor 153 outputs a value indicating an absolute direction.

Figure 5:
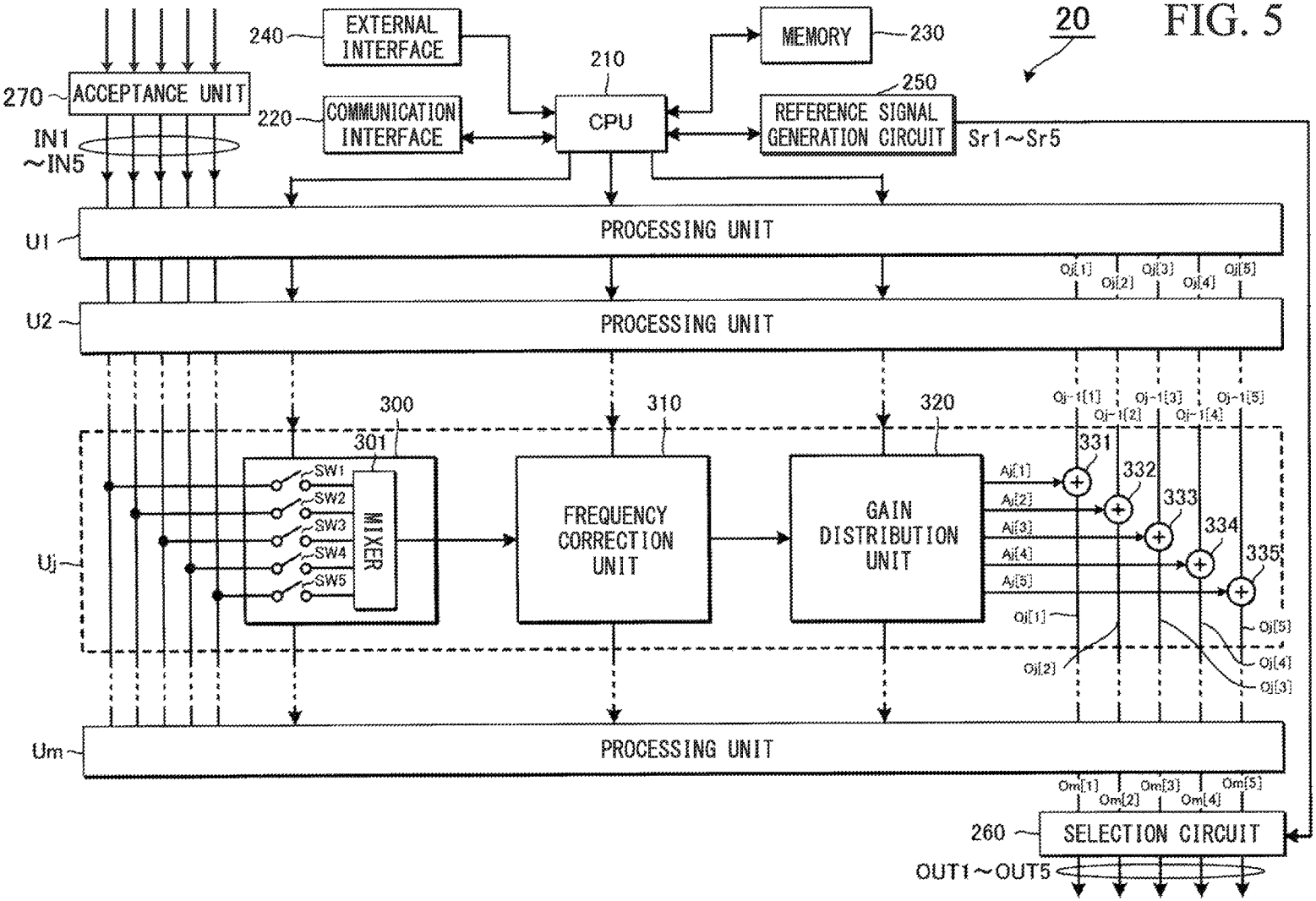
FIG. 5 is a block diagram showing an example of a hardware configuration of a sound apparatus according to the present embodiment.

In the example shown in FIG. 5, the sound apparatus 20 includes a CPU 210, a communication interface 220, a memory 230, an external interface 240, a reference signal generation circuit 250, a selection circuit 260, an acceptance unit 270, and m processing units U1 to Um. The CPU 210 functions as a control center of the entire apparatus. The communication interface 220 executes communication with the outside. The memory 230 memorizes programs and data, and functions as a work area of the CPU 210. The external interface 240 accepts an input of a signal from an external device such as a microphone, and supplies the signal to the CPU 210. The reference signal generation circuit 250 generates reference signals Sr1 to Sr5. The acceptance unit 270 accepts inputs of the input audio signals IN1 to IN5, and inputs them to the processing units U1 to Um. As another configuration, the external interface 240 may accept the inputs of the input audio signals IN1 to IN5 and input them to the processing units U1 to Um. The processing units U1 to Um and the CPU 210 generate output audio signals OUT1 to OUT5, by imparting the sound effects to the input audio signals IN1 to IN5, based on the loudspeaker position information indicating the position of the respective loudspeakers SP1 to SP5, the listening position information indicating the listening position P, and virtual sound source position information indicating the position of the virtual sound source (coordinate information). A selection circuit 280 outputs the output audio signals OUT1 to OUT5 to the loudspeakers SP1 to SP5.

The j-th processing unit Uj includes a virtual sound source generation unit (hereinafter, simply referred to as "conversion unit") 300, a frequency correction unit 310, a gain distribution unit 320, and adders 331 to 335 ("j" is an arbitrary natural number satisfying $1 \leq j \leq m$). The processing units U1, U2, and so forth, Uj−1, Uj+1, and so forth, and Um are configured to be the same as the processing unit Uj.

The conversion unit 300 generates an audio signal of the virtual sound source based on the input audio signals IN1 to IN5. In the example, because m processing units U1 to Um are provided, the output audio signals OUT1 to OUT5 corresponding to m virtual sound sources can be generated. The conversion unit 300 includes 5 switches SW1 to SW5, and a mixer 301. The CPU 210 controls the conversion unit 300. More specifically, the CPU 210 memorizes a virtual sound source management table for managing m virtual sound sources in the memory 230, and controls the conversion unit 300 by referring to the virtual sound source management table. Reference data representing which input audio signals IN1 to IN5 need to be mixed, is stored in the virtual sound source management table, for the respective virtual sound sources. The reference data may be, for example, a channel identifier indicating a channel to be mixed, or a logical value representing whether to perform mixing for each channel. The CPU 210 refers to the virtual sound source management table to sequentially turn on the switches corresponding to the input audio signals to be mixed, of the input audio signals IN1 to IN5, and fetches the input audio signals to be mixed. As a specific example, a case where the input audio signals to be mixed are the input audio signals IN1, IN2, and IN5 will be described here. In this case, the CPU 210 first switches on the switch SW1 corresponding to the input audio signal IN1, and switches off the other switches SW2 to SW5. Next, the CPU 210 switches on the switch SW2 corresponding to the input audio signal IN2, and switches off the other switches SW1, and SW3 to SW5. Subsequently, the CPU 210 switches on the switch SW5 corresponding to the input audio signal IN5, and switches off the other switches SW1 to SW4.

The frequency correction unit 310 performs frequency correction on an output signal of the conversion unit 300. Specifically, under control of the CPU 210, the frequency correction unit 310 corrects a frequency characteristic of the output signal according to the distance from the position of the virtual sound source to the reference position Pref. More specifically, the frequency correction unit 310 corrects the frequency characteristic of the output signal such that high-pass frequency components are largely attenuated, as the distance from the position of the virtual sound source to the reference position Pref increases. This is for reproducing sound characteristics such that an attenuation amount of the high frequency components increases, as the distance from the virtual sound source to the reference position Pref increases.

The memory 230 memorizes an attenuation amount table beforehand. In the attenuation amount table, data representing a relation between the distance from the virtual sound source to the reference position Pref, and the attenuation amount of the respective frequency components is stored. In the virtual sound source management table, the virtual sound source position information indicating the positions of the respective virtual sound sources is stored. The virtual sound source position information may be given, for example, in three-dimensional orthogonal coordinates or two-dimensional orthogonal coordinates, with the reference position Pref as the origin. The virtual sound source position information may be represented by polar coordinates. In this example, the virtual sound source position information is given by coordinate information of two-dimensional orthogonal coordinates.

The CPU 210 executes first to third processes described below. As a first process, the CPU 210 reads contents of the virtual sound source management table memorized in the memory 230. Further, the CPU 210 calculates the distance from the respective virtual sound sources to the reference position Pref, based on the read contents of the virtual sound source management table. As a second process, the CPU 210 refers to the attenuation amount table to acquire the attenuation amounts of the respective frequencies according to the calculated distance to the reference position Pref. As a third process, the CPU 210 controls the frequency correction unit 310 so that a frequency characteristic corresponding to the acquired attenuation amount can be acquired.

Under control of the CPU 210, the gain distribution unit 320 distributes the output signal of the frequency correction unit 310 to a plurality of audio signals Aj[1] to Aj[5] for the loudspeakers SP1 to SP5. At this time, the gain distribution unit 320 amplifies the output signal of the frequency correction unit 310 at a predetermined ratio for each of the audio signals Aj[1] to Aj[5]. The size of the gain of the audio signal with respect to the output signal decreases, as the distances between the respective loudspeakers SP1 to SP5 and the virtual sound source increases. According to such a process, a sound field as if sound was emitted from a place set as the position of the virtual sound source can be formed. For example, the size of the gain of the respective audio signals Aj[1] to Aj[5] may be proportional to a reciprocal of the distances between the respective loudspeakers SP1 to SP5 and the virtual sound source. As another method, the size of the gain may be set so as to be proportional to a reciprocal of the square or the fourth power of the distances between the respective loudspeakers SP1 to SP5 and the virtual sound source. If the distance between any of the loudspeakers SP1 to SP5 and the virtual sound source is substantially zero (0), the size of the gain of the audio signals Aj[1] to Aj[5] with respect to the other loudspeakers SP1 to SP5 may be set to zero (0).

The memory 230 memorizes, for example, a loudspeaker management table. In the loudspeaker management table, the loudspeaker position information indicating the respective positions of the loudspeakers SP1 to SP5 and information indicating the distances between the respective loudspeakers SP1 to SP5 and the reference position Pref are stored, in association with identifiers of the respective loudspeakers SP1 to SP5. The loudspeaker position information is represented by, for example, three-dimensional orthogonal coordinates, two-dimensional orthogonal coordinates, or polar coordinates, with the reference position Pref as the origin.

As the first process, the CPU 210 refers to the virtual sound source management table and the loudspeaker management table stored in the memory 230, and calculates the distances between the respective loudspeakers SP1 to SP5 and the respective virtual sound sources. As the second process, the CPU 210 calculates the gain of the audio signals Aj[1] to Aj[5] with respect to the respective loudspeakers SP1 to SP5 based on the calculated distances, and supplies a control signal designating the gain to the respective processing units U1 to Um.

The adders 331 to 335 of the processing unit Uj add the audio signals Aj[1] to Aj[5] output from the gain distribution unit 320 and audio signals Oj−1[1] to Oj−1[5] supplied from the processing unit Uj−1 in the previous stage, and generate and output audio signals Oj[1] to Oj[5]. As a result, an audio signal Om[k] output from the processing unit Um becomes Om[k]=A1[k]+A2[k]+ . . . +Aj[k]+ . . . +Am[k] ("k" is an arbitrary natural number from 1 to 5).

Under control of the CPU 210, the reference signal generation circuit 250 generates the reference signals Sr1 to Sr5, and outputs them to the selection circuit 260. The reference signals Sr1 to Sr5 are used for the measurement of the distances between the respective loudspeakers SP1 to SP5 and the reference position Pref (a microphone M). At the time of measurement of the distances between each of the loudspeakers SP1 to SP5 and the reference position Pref, the CPU 210 causes the reference signal generation circuit 250 to generate the reference signals Sr1 to Sr5. When the distances to each of the plurality of loudspeakers SP1 to SP5 are to be measured, the CPU 210 controls the selection circuit 260 to select the reference signals Sr1 to Sr5 and supply them to each of the loudspeakers SP1 to SP5. At the time of imparting the sound effects, the CPU 210 controls the selection circuit 260 to supply each of the loudspeakers SP1 to SP5 with the audio signals Om[1] to Om[5] that are obtained by selecting the output audio signals OUT1 to OUT5.

<Operation of the Sound System>

Next, an operation of the sound system will be described by dividing the operation into specification of the position of the loudspeaker and designation of the position of the virtual sound source.

<Specification Process for the Position of the Loudspeaker>

At the time of specifying the position of the loudspeaker, first to third processes are executed. As the first process, the distances between the respective loudspeakers SP1 to SP5 and the reference position Pref are measured. As the second process, the direction in which the respective loudspeakers SP1 to SP5 are arranged is measured. As the third process, the respective positions of the loudspeakers SP1 to SP5 are specified based on the measured distance and direction.

Figure 6:
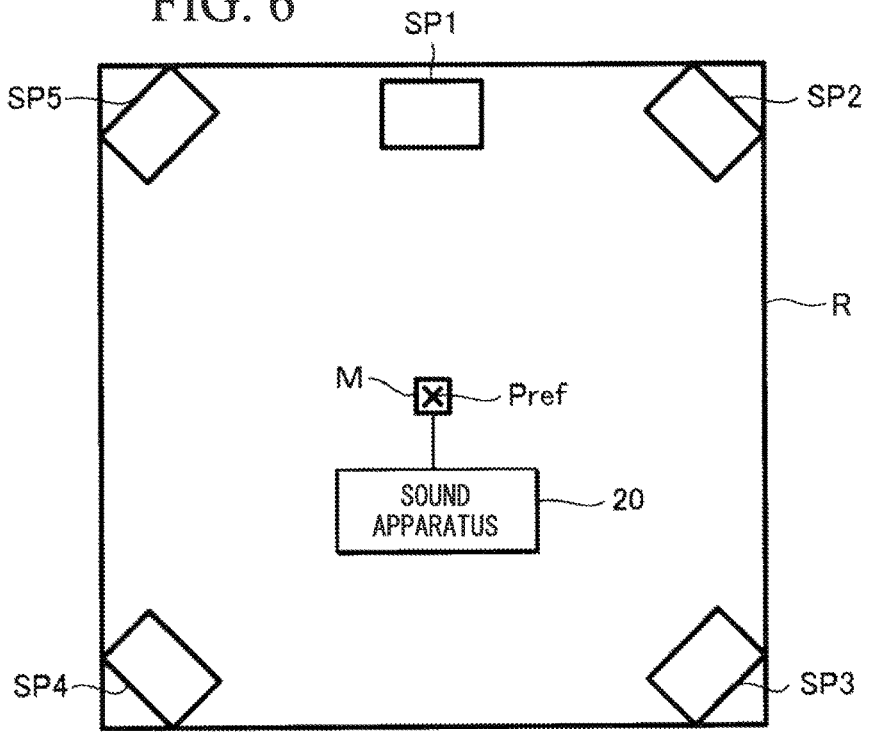
FIG. 6 is a plan view showing an arrangement of a microphone at the time of measuring a distance to loudspeakers, in the present embodiment.
Figure 7:
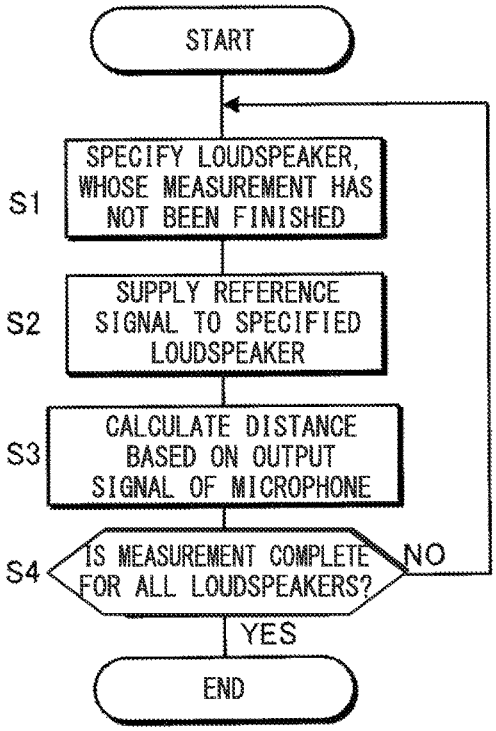
FIG. 7 is a flowchart showing the content of a distance measurement process between the plurality of loudspeakers and the reference position, in the present embodiment.

In the measurement of the distance, as shown in FIG. 6, the microphone M is arranged at the reference position Pref, and the microphone M is connected to the sound apparatus 20. The output signal of the microphone M is supplied to the CPU 210 via the external interface 240. FIG. 7 shows the content of a measurement process for the distances between the loudspeakers SP1 to SP5 and the reference position Pref, to be executed by the CPU 210 of the sound apparatus 20.

(Step S1)

The CPU 210 specifies one loudspeaker, for which measurement has not been finished, as the loudspeaker to be a measurement subject. For example, if measurement of the distance between the loudspeaker SP1 and the reference position Pref has not been performed, the CPU 210 specifies the loudspeaker SP1 as the loudspeaker to be a measurement subject.

(Step S2)

The CPU 210 controls the reference signal generation circuit 250 so as to generate the reference signal corresponding to the loudspeaker to be a measurement subject, of the reference signals Sr1 to Sr5. Moreover, the CPU 210 controls the selection circuit 260 so that the generated reference signal is supplied to the loudspeaker to be a measurement subject. At this time, the generated reference signal is output as one of the output audio signals OUT1 to OUT5 corresponding to the loudspeaker to be a measurement subject. For example, the CPU 210 controls the selection circuit 260 so that the generated reference signal Sr1 is output as the output audio signal OUT1 corresponding to the loudspeaker SP1 to be a measurement subject.

(Step S3)

The CPU 210 calculates the distance between the loudspeaker to be a measurement subject and the reference position Pref, based on the output signal of the microphone M. Moreover, the CPU 210 records the calculated distance in the loudspeaker management table, in association with the identifier of the loudspeaker to be a measurement subject.

(Step S4)

The CPU 210 determines whether the measurement of all loudspeakers is complete. If there is a loudspeaker whose measurement has not been finished (NO in step S4), the CPU 210 returns the process to step S1, and repeats the process from step S1 to step S4 until the measurement of all loudspeakers is complete. If the measurement of all loudspeakers is complete (YES in step S4), the CPU 210 finishes the process.

According to the above process, the distances from the reference position Pref to each of the loudspeakers SP1 to SP5 are measured.

Figure 8:
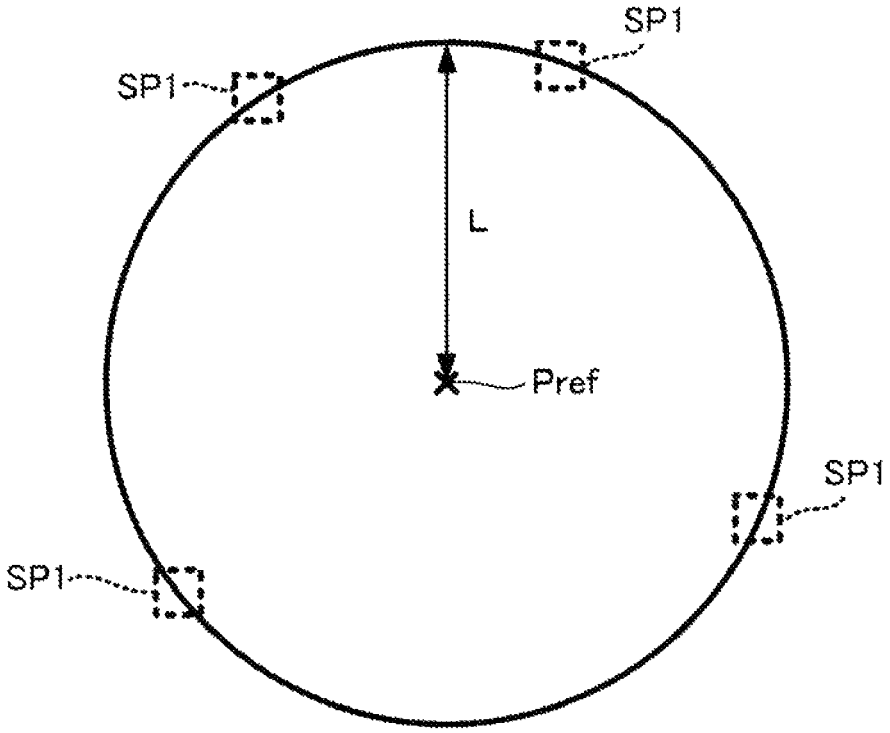
FIG. 8 is an explanatory diagram showing the positions of the loudspeakers ascertained by distance measurement results, in the present embodiment.

For example, it is assumed that the distance from the reference position Pref to the loudspeaker SP1 is "L". In this case, as shown in FIG. 8, it is seen that the loudspeaker SP1 is on a circle having a radius L from the reference position Pref. However, it is not specified at which position on the circle the loudspeaker SP1 is. Therefore, in the present embodiment the direction of the loudspeaker SP1 as seen from the reference position Pref is measured by using the terminal apparatus 10 to specify the position of the loudspeaker SP1.

Figure 9:
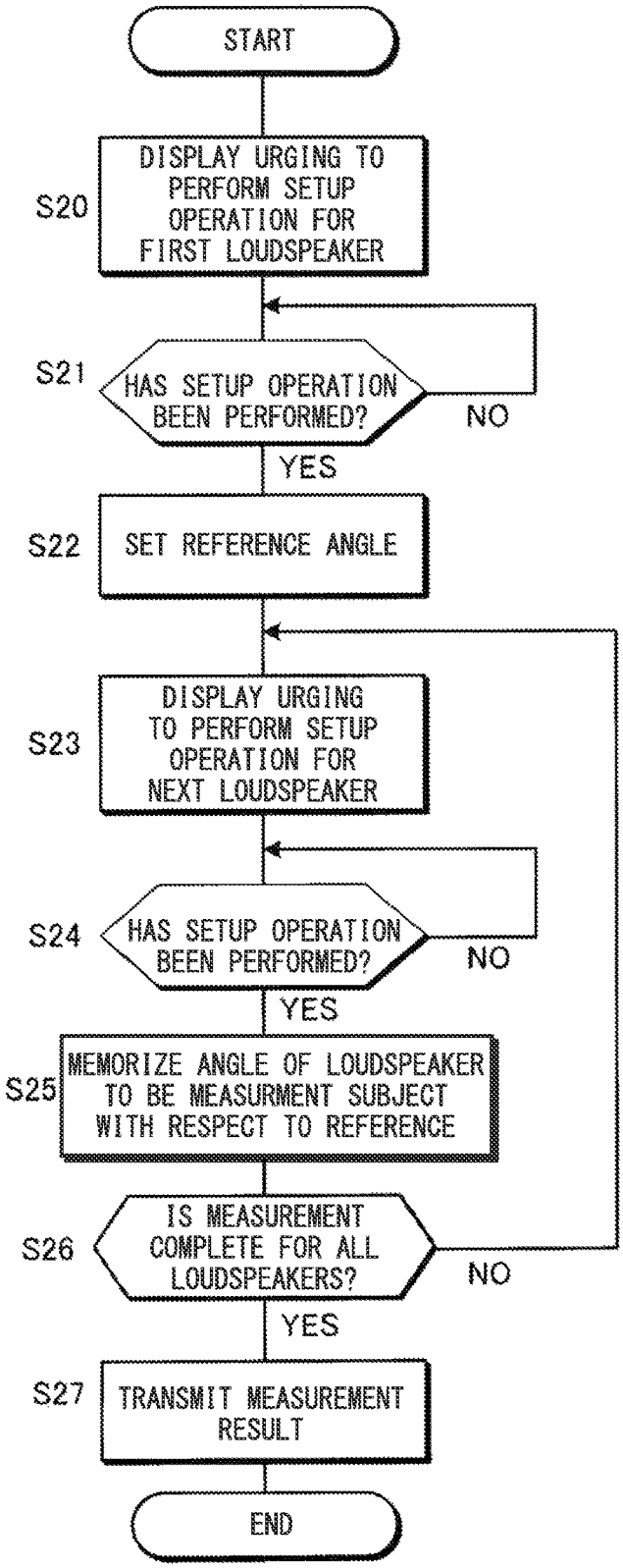
FIG. 9 is a flowchart showing a content of a direction measurement process, in the present embodiment.

FIG. 9 shows the content of a direction measurement process executed by the CPU 100 of the terminal apparatus 10. In the example, the respective arrangement directions of the plurality of loudspeakers SP1 to SP5 are specified by using at least one of the gyro sensor 151 and the acceleration sensor 152. As described above, the gyro sensor 151 and the acceleration sensor 152 output an angle. In the example, the reference of the angle is the loudspeaker whose arrangement direction is measured first.

(Step S20)

Figure 10:
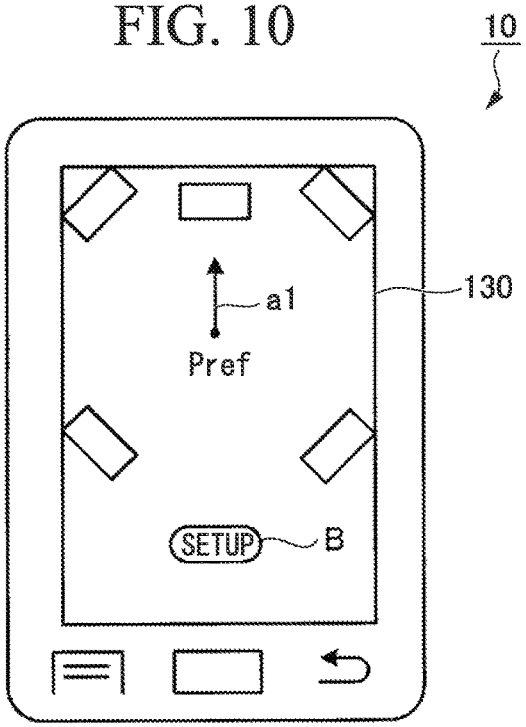
FIG. 10 is an explanatory diagram showing an example of an image to be displayed on a display unit in the direction measurement process, in the present embodiment.

Upon startup of the application of the direction measurement process, the CPU 100 causes the display unit 130 to display an image urging the user A to perform a setup operation in a state with the terminal apparatus 10 oriented toward the first loudspeaker. For example, if the arrangement direction of the loudspeaker SP1 is set first, as shown in FIG. 10, the CPU 100 displays an arrow a1 oriented toward the loudspeaker SP1 on the display unit 130.

(Step S21)

The CPU 100 determines whether the setup operation has been performed by the user A. Specifically, the CPU 100 determines whether the user A has pressed a setup button B (a part of the above-described operating unit 120) shown in FIG. 10. If the setup operation has not been performed, the CPU 100 repeats determination until the setup operation is performed.

(Step S22)

If the setup operation is performed, the CPU 100 sets the measurement angle measured by the gyro sensor 151 or the acceleration sensor 152 as the angle to be the reference at the time of operation. That is to say, the CPU 100 sets the direction from the reference position Pref toward the loudspeaker SP1 to 0 degree.

(Step S23)

Figure 11:
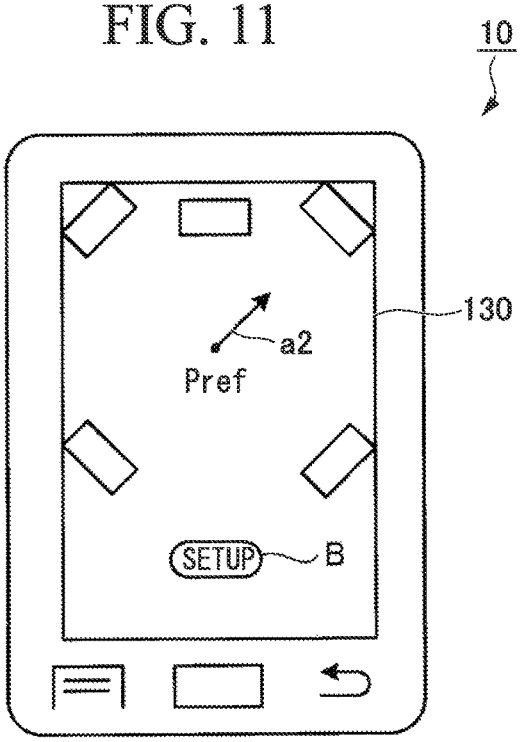
FIG. 11 is an explanatory diagram showing an example of an image to be displayed on the display unit in the direction measurement process, in the present embodiment.

The CPU 100 causes the display unit 130 to display an image urging the user to perform the setup operation in a state with the terminal apparatus 10 oriented toward the next loudspeaker. For example, if the arrangement direction of the loudspeaker SP2 is set secondarily, as shown in FIG. 11, the CPU 100 displays an arrow a2 oriented toward the loudspeaker SP2 on the display unit 130.

(Step S24)

The CPU 100 determines whether the setup operation has been performed by the user A. Specifically, the CPU 100 determines whether the user has pressed the setup button B shown in FIG. 11. If the setup operation has not been performed, the CPU 100 repeats determination until the setup operation is performed.

(Step S25)

If the setup operation is performed, the CPU 100 uses the output value of the gyro sensor 151 or the acceleration sensor 152 at the time of operation to memorize the angle of the loudspeaker to be a measurement subject with respect to the reference, in the memory 110.

(Step S26)

The CPU 100 determines whether measurement is complete for all loudspeakers. If there is a loudspeaker whose measurement has not been finished (NO in step S26), the CPU 100 returns the process to step S23, and repeats the process from step S23 to step S26 until the measurement is complete for all loudspeakers.

(Step S27)

If measurement of the direction is complete for all loudspeakers, the CPU 100 transmits a measurement result to the sound apparatus 20 by using the communication interface 140.

According to the above process, the respective directions in which the loudspeakers SP1 to SP5 are arranged are measured. In the above-described example, the measurement results are collectively transmitted to the sound apparatus 20. However, it is not limited to such a process. The CPU 100 may transmit the measurement result to the sound apparatus 20 every time the arrangement direction of one loudspeaker is measured. As described above, the arrangement direction of the loudspeaker SP1 to be a measurement subject first is used as the reference of the angle of the other loudspeakers SP2 to SP5. The measurement angle relating to the loudspeaker SP1 is 0 degree. Therefore, transmission of the measurement result relating to the loudspeaker SP1 may be omitted.

Thus, in the case where the respective arrangement directions of the loudspeakers SP1 to SP5 are specified by using the angle with respect to the reference, the load on the user A can be reduced by setting the reference to one of the loudspeakers SP1 to SP5.

Here, a case where the reference of the angle does not correspond to any of the loudspeakers SP1 to SP5, and the reference of the angle is an arbitrary object arranged in the listening room R will be described. In this case, the user A orients the terminal apparatus 10 to the object, and performs setup of the reference angle by performing a predetermined operation in this state. Further, the user A performs the predetermined operation in a state with the terminal apparatus 10 oriented towards each of the loudspeakers SP1 to SP5, thereby designating the direction.

Accordingly, if the reference of the angle is an arbitrary object arranged in the listening room R, an operation performed in the state with the terminal apparatus 10 oriented toward the object is required additionally. On the other hand, by setting the object to any one of the loudspeakers SP1 to SP5, the input operation can be simplified.

The CPU 210 of the sound apparatus 20 acquires the (information indicating) arrangement direction of each of the loudspeakers SP1 to SP5 by using the communication interface 220. The CPU 210 calculates the respective positions of the loudspeakers SP1 to SP5 based on the arrangement direction and the distance of each of the loudspeakers SP1 to SP5.

Figure 12:
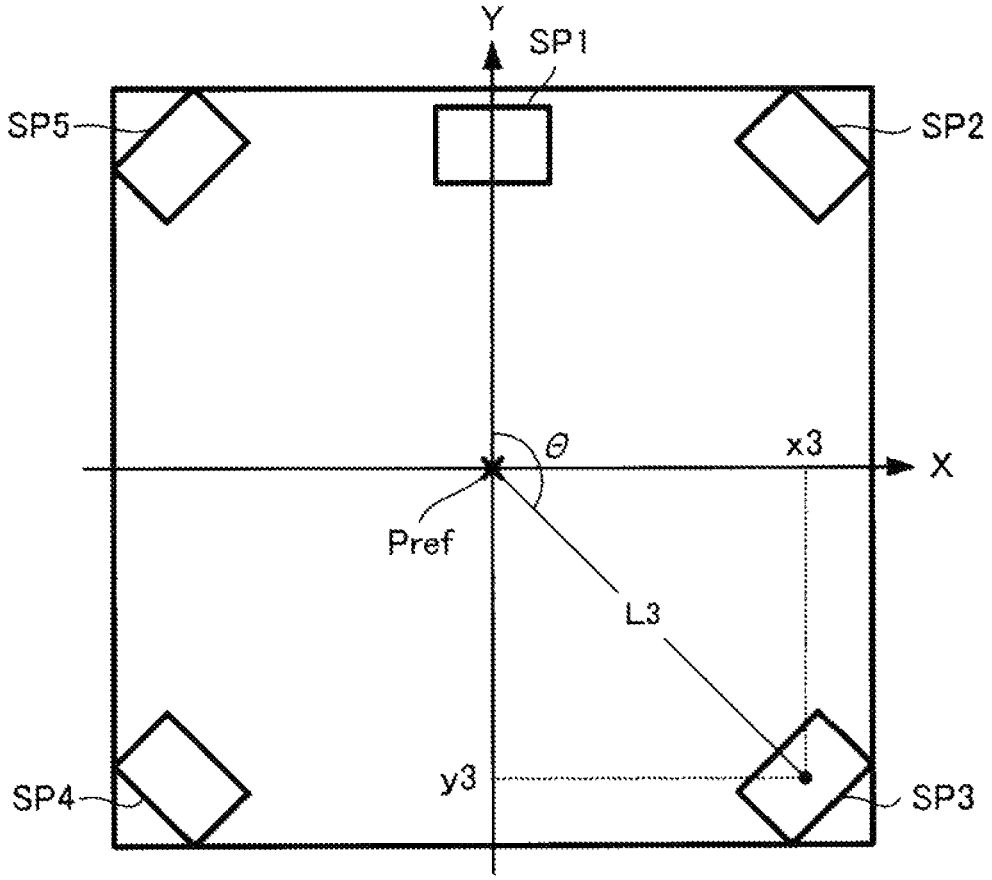
FIG. 12 is an explanatory diagram showing an example of calculation of the positions of the loudspeakers, in the present embodiment.

As a specific example, as shown in FIG. 12, a case where the arrangement direction of the loudspeaker SP3 is an angle θ, and the distance to the loudspeaker SP3 is L3 will be described. In this case, the CPU 210 calculates the coordinates (x3, y3) of the loudspeaker SP3 according to Equation (A) shown below, as loudspeaker position information.

$$(x3,y3)=(L3 \sin \theta, L3 \cos \theta) \quad \text{Equation (A)}$$

The coordinates (x, y) for the other loudspeakers SP1, SP2, SP4, and SP5 are also calculated in a similar manner.

Thus, the CPU 210 calculates the loudspeaker position information indicating the respective positions of the loudspeakers SP1 to SP5 based on the distance from the reference position Pref to the respective loudspeakers SP1 to SP5, and the arrangement direction of the respective loudspeakers SP1 to SP5.

<Designation Process for the Position of the Virtual Sound Source>

Next, the designation process for the position of the virtual sound source is described. In the present embodiment, designation of the position of the virtual sound source is performed by using the terminal apparatus 10.

Figure 13:
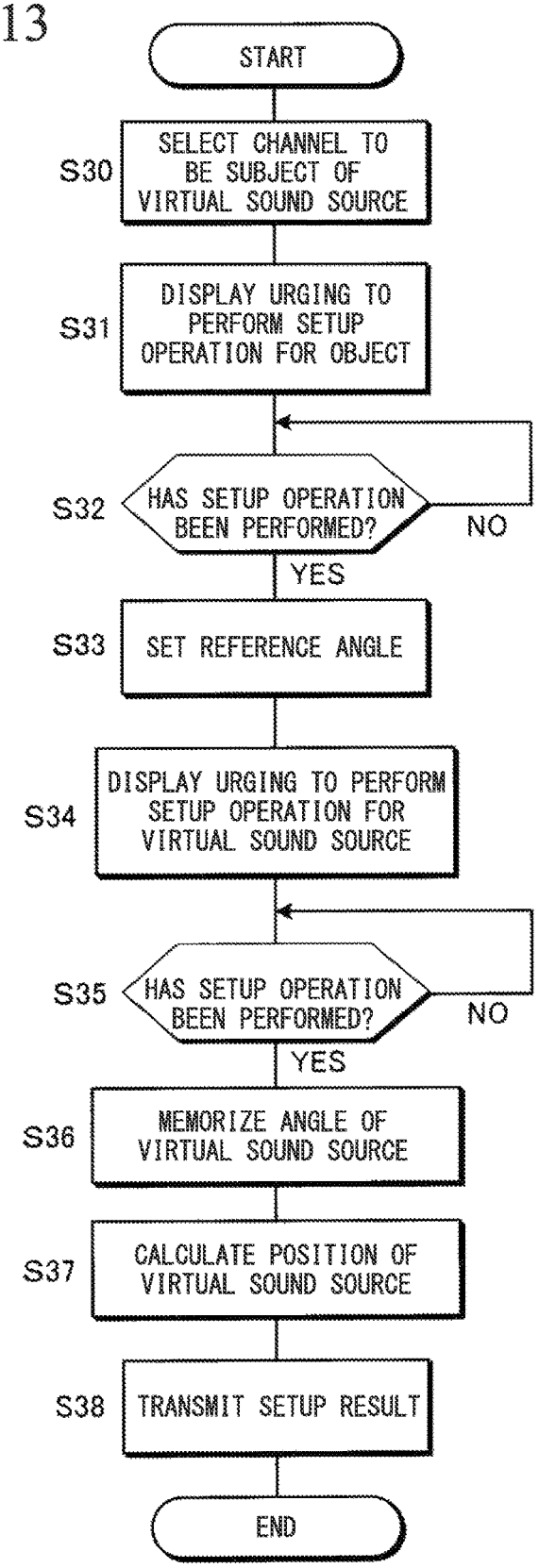
FIG. 13 is a flowchart showing the content of a designation process for a position of a virtual sound source, in the present embodiment.

FIG. 13 shows the content of the designation process for the position of the virtual sound source executed by the CPU 100 of the terminal apparatus 10.

(Step S30)

Figure 14:
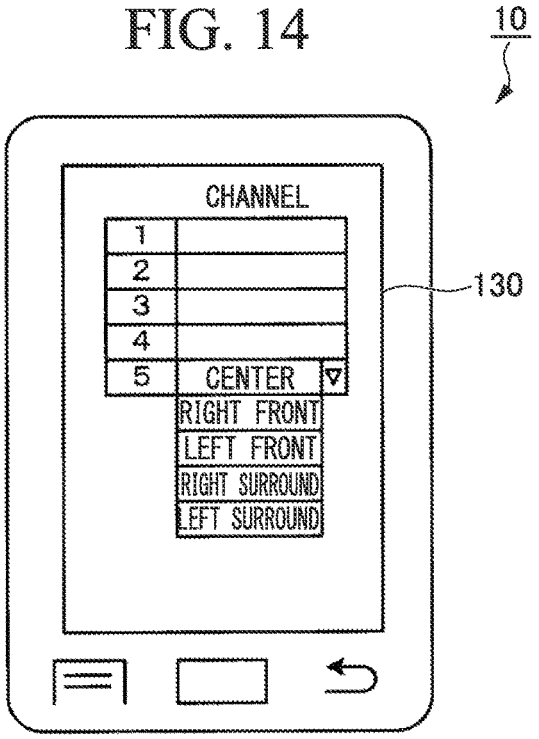
FIG. 14 is an explanatory diagram showing an example of an image to be displayed on the display unit in the designation process for the position of the virtual sound source, in the present embodiment.

The CPU 100 causes the display unit 130 to display an image urging the user A to select a channel to be a subject of a virtual sound source, and acquires the number of the channel selected by the user A. For example, the CPU 100 causes the display unit 130 to display the screen shown in FIG. 14. In the example, the number of virtual sound sources is 5. Numbers of "1" to "5" are allocated to each of the virtual sound sources. The channel can be selected by a pull-down menu. In FIG. 14, the channel corresponding to the virtual sound source number "5" is displayed in the pull-down menu. The channel includes center, right front, left front, right surround, and left surround. When the user A selects an arbitrary channel from the pull-down menu, the CPU 100 acquires the selected channel.

(Step S31)

The CPU 100 causes the display unit 130 to display an image urging the user to perform the setup operation in a state with the terminal apparatus 10 positioned at the listening position P and oriented toward the object. It is desired that the object agrees with the object used as the reference of the angle of the loudspeaker in the specification process for the position of the loudspeaker. Specifically, it is desired to set the object to the loudspeaker SP1 to be set first.

(Step S32)

The CPU 100 determines whether the setup operation has been performed by the user A. Specifically, the CPU 100 determines whether the user A has pressed the setup button B shown in FIG. 10. If the setup operation has not been performed, the CPU 100 repeats the determination until the setup operation is performed.

(Step S33)

If the setup operation is performed, the CPU 100 sets the measurement angle measured by the gyro sensor 151 and the like at the time of operation, as the angle to be the reference. That is to say, the CPU 100 sets the direction from the listening position P toward the loudspeaker SP1 being the predetermined object, to 0 degree.

(Step S34)

Figure 15:
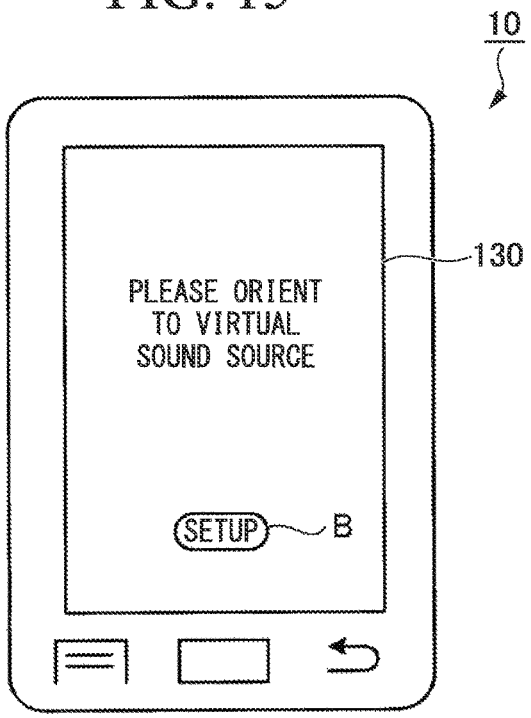
FIG. 15 is an explanatory diagram showing an example of an image to be displayed on the display unit in the designation process for the position of the virtual sound source, in the present embodiment.

The CPU 100 causes the display unit 130 to display an image urging the user to perform the setup operation in a state with the terminal apparatus 10 positioned at the listening position P and oriented toward the direction in which the user desires to arrange the virtual sound source. For example, the CPU 100 may cause the display unit 130 to display the screen shown in FIG. 15.

(Step S35)

The CPU 100 determines whether the user A has performed the setup operation. Specifically, the CPU 100 determines whether the user A has pressed the setup button B shown in FIG. 15. If the setup operation has not been performed, the CPU 100 repeats the determination until the setup operation is performed.

(Step S36)

If the setup operation is performed, the angle of the virtual sound source with respect to the predetermined object (that is, an angle formed by the arrangement direction of the object and the arrangement direction of the virtual sound source) is memorized in the memory 110 as first direction information, by using an output value of the gyro sensor 151 or the like at the time of operation.

(Step S37)

The CPU 100 calculates the position of the virtual sound source. In calculation of the position of the virtual sound source, the first direction information indicating the direction of the virtual sound source, the listening position information indicating the position of the listening position P, and boundary information are used.

In the present embodiment, the virtual sound source can be arranged on a boundary in an arbitrary space that can be designated by the user A. In this example, the space is the listening room R, and the boundary of the space is walls of the listening room R. Here, a case where the space is expressed two-dimensionally is described. The boundary information indicating the boundary of the space (walls of the listening room R) two-dimensionally has been memorized in the memory 110 beforehand. The boundary information may be input to the terminal apparatus 10 by the user A. The boundary information is managed by the sound apparatus 20, and may be memorized in the memory 110, by transferring it from the sound apparatus 20 to the terminal apparatus 10. The boundary information may be information indicating a rectangle surrounding the furthermost position at which the virtual sound source can be arranged in the listening room R, taking into consideration the size of the respective loudspeakers SP1 to SP5.

Figure 16:
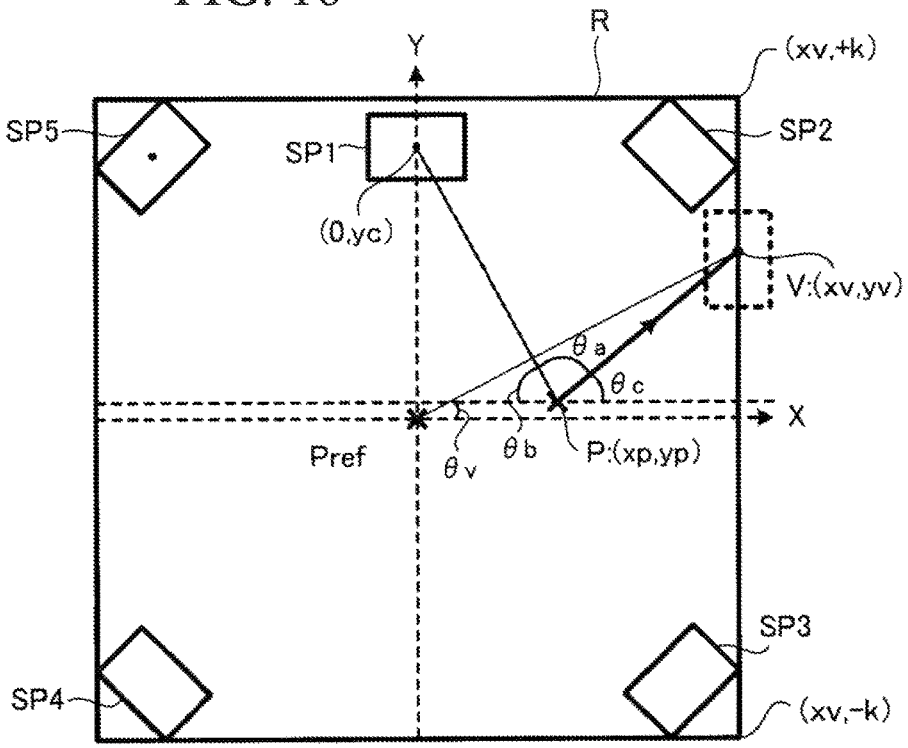
FIG. 16 is a diagram for explaining calculation of virtual sound source position information, in the present embodiment.

FIG. 16 is a diagram for explaining calculation of a virtual sound source position V. In this example, the listening position information is indicated by an XY coordinate with the reference position Pref as the origin, and is known. The listening position information is expressed by (xp, yp). The boundary information indicates the position of the walls of the listening room R. For example, the right side wall of the listening room R is expressed by (xv, ya), provided that "$-k<ya<+k$", and "k" and "xv" are known. The loudspeaker position information indicating the position of the loudspeaker SP1, being the predetermined object, is known. The loudspeaker position information is expressed by (0, yc). The angle formed by the loudspeaker SP1, being the predetermined object and the virtual sound source position V as seen from the listening position P is expressed by "θa". The angle formed by the object and a negative direction of the X axis as seen from the listening position P is expressed by "θb". The angle formed by the object and a positive direction of the X axis as seen from the listening position P is expressed by "θc". The angle formed by the virtual sound source position V and the positive direction of the X axis as seen from the reference position Pref is expressed by "θv".

"θb" and "θc" are given by Equations (1) and (2) described below.

$$\theta b = a \tan\{(yc - yp)/xp\} \quad \text{Equation (1)}$$

$$\theta c = 180 - \theta a - \theta b \quad \text{Equation (2)}$$

"yv" is given by Equation (3) described below.

$$\begin{aligned} yv &= \sin\theta c + yp \quad \text{Equation (3)} \\ &= yp + \sin(180 - \theta a - \theta b) \\ &= yp + \sin[180 - \theta a - a\tan\{(ya - yp)/xp\}] \end{aligned}$$

Accordingly, the virtual sound source position information indicating the virtual sound source position V is expressed as described below.

$$(xv, yp + \sin[180 - \theta a - a \tan\{(ya - yp)/xp\}])$$

(Step S38)

Explanation is returned to FIG. 13. The CPU 100 transmits the virtual sound source position information and the listening position information to the sound apparatus 20 as a setup result. If the sound apparatus 20 has already memorized the listening position information, the CPU 100 may transmit only the virtual sound source position information to the sound apparatus 20 as the setup result.

The CPU 210 of the sound apparatus 20 receives the setup result by using the communication interface 220. The CPU 210 controls the processing units U1 to Um based on the loudspeaker position information, the listening position information, and the virtual sound source position information, so that sound is heard from the virtual sound source position V. As a result, the output audio signals OUT1 to OUT5 that have been subjected to sound processing such that the sound of the channel designated by using the terminal apparatus 10 is heard from the virtual sound source position V, are generated.

According to the above-described processes, the reference of the angle of the loudspeakers SP1 to SP5 is matched with the reference of the angle of the virtual sound source. As a result, specification of the arrangement direction of the virtual sound source can be executed by the same process as that for specifying the arrangement directions of the plurality of loudspeakers SP1 to SP5. Consequently, because two processes can be commonalized, specification of the position of the loudspeaker and specification of the position of the virtual sound source can be performed by using the same program module. Moreover, because the user A uses the common object (in the example, the loudspeaker SP1) as the reference of the angle, an individual object need not be memorized.

<Functional Configuration of the Sound System 1A)

Figure 17:
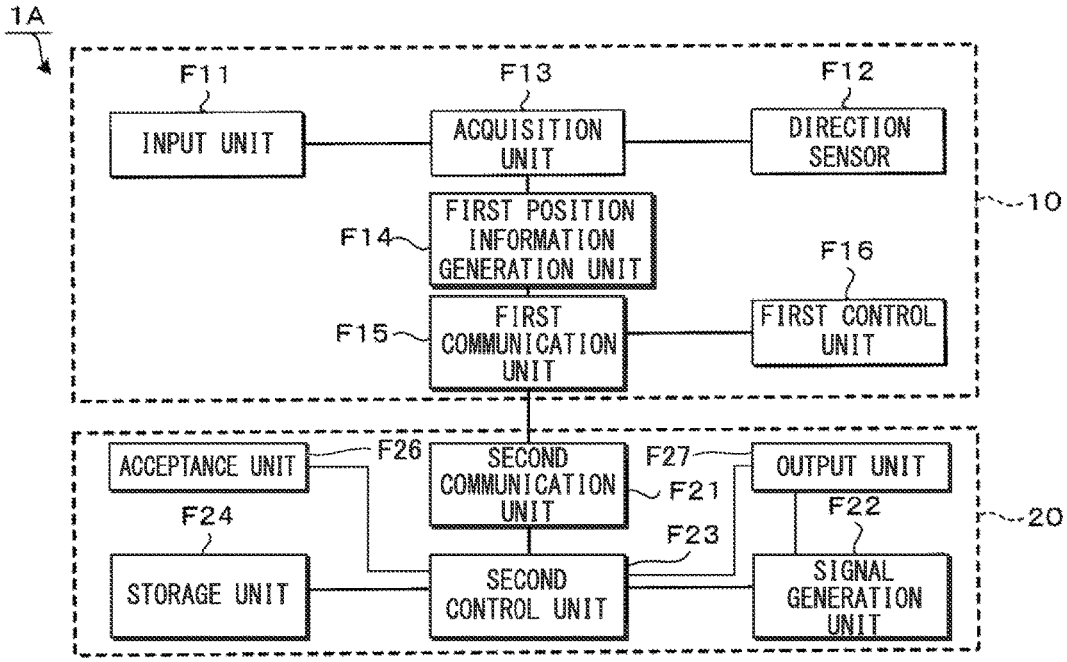
FIG. 17 is a functional block diagram showing a functional configuration of a sound system, according to the present embodiment.

As described above, the sound system 1A includes the terminal apparatus 10 and the sound apparatus 20. The terminal apparatus 10 and the sound apparatus 20 share various functions. FIG. 17 shows functions to be shared by the terminal apparatus 10 and the sound apparatus 20 in the sound system 1A.

The terminal apparatus 10 includes an input unit F11, a first communication unit F15, a direction sensor F12, an acquisition unit F13, a first position information generation unit F14, and a first control unit F16. The input unit F11 accepts an input of an instruction from the user A. The first communication unit F15 communicates with the sound apparatus 20. The direction sensor F12 detects the direction in which the terminal apparatus 10 is oriented.

The input unit F11 corresponds to the operating unit 120 described above. The first communication unit F15 corresponds to the communication interface 140 described above. The direction sensor F12 corresponds to the gyro sensor 151, the acceleration sensor 152, and the orientation sensor 153.

The acquisition unit F13 corresponds to the CPU 100. At the listening position P for listening to the sound, when the user A inputs that the terminal apparatus 10 is oriented toward the first direction, being the direction of the virtual sound source, by using the input unit F11 (step S35 described above), the acquisition unit F13 acquires the first direction information indicating the first direction based on an output signal of the direction sensor F12 (step S36 described above). In the case where the first direction is an angle with respect to the predetermined object (for example, the loudspeaker SP1), when the user A inputs that the terminal apparatus 10 is oriented toward the predetermined object by using the input unit F11, it is desired that the angle to be specified based on the output signal of the direction sensor F12 is set to the reference angle.

The first position information generation unit F14 corresponds to the CPU 100. The first position information generation unit F14 generates the virtual sound source position information indicating the position of the virtual sound source, based on the listening position information indicating the listening position P, the first direction information, and the boundary information indicating the boundary of the space in which the virtual sound source is arranged (step S37 described above).

The first control unit F16 corresponds to the CPU 100. The first control unit F16 transmits the virtual sound source position information to the sound apparatus 20 by using the first communication unit F15 (step S38 described above).

The sound apparatus 20 includes a second communication unit F21, a signal generation unit F22, a second control unit F23, a storage unit F24, an acceptance unit F26, and an output unit F27. The second communication unit F21 communicates with the terminal apparatus 10.

The second communication unit F21 corresponds to the communication interface 220. The storage unit F24 corresponds to the memory 230.

The signal generation unit F22 corresponds to the CPU 210 and the processing units U1 to Um. The signal generation unit F22 imparts sound effects to the input audio signals IN1 to IN5 such that sounds are heard at the listening position P as if those sounds came from the virtual sound source, based on the loudspeaker position information indicating the respective positions of the plurality of loudspeakers SP1 to SP5, the listening position information, and the virtual sound source position information, to generate the output audio signals OUT1 to OUT5.

When the second communication unit F21 receives the virtual sound source position information transmitted from the terminal apparatus 10, the second control unit F23 supplies the virtual sound source position information to the signal generation unit F22.

The storage unit F24 memorizes therein the loudspeaker position information, the listening position information, and the virtual sound source position information. The sound apparatus 20 may calculate the loudspeaker position information and the listening position information. The terminal apparatus 10 may calculate the loudspeaker position information and the listening position information, and transfer them to the sound apparatus 20.

The acceptance unit F26 corresponds to the acceptance unit 270 or the external interface 240. The output unit F27 corresponds to the selection circuit 260.

As described above, according to the present embodiment, when the user A listens to the sound emitted from the plurality of loudspeakers SP1 to SP5 at the listening position P, the user A can arrange the virtual sound source on the boundary of the preset space, by only operating the terminal apparatus 10 in the state with it being oriented toward the first direction, being the arrangement direction of the virtual sound source, at the listening position P. As described above, the listening position P is different from the reference position Pref, being the reference of the loudspeaker position information. The signal generation unit F22 imparts sound effects to the input audio signals IN1 to IN5 such that sounds are heard at the listening position P as if those sounds came from the virtual sound source, based on the loudspeaker position information, the listening position information, and the virtual sound source position information, to generate the output audio signals OUT1 to OUT5. Accordingly, the user A can listen to the sound of the virtual sound source from a desired direction, at an arbitrary position in the listening room R.

Modification Example

The present invention is not limited to the above-descried embodiment, and various modifications described below are possible. Moreover, the respective modification examples and the embodiment described above can be appropriately combined.

First Modification Example

In the embodiment described above, the terminal apparatus 10 generates the virtual sound source position information, and transmits the information to the sound apparatus 20. However, the present invention is not limited to this configuration. The terminal apparatus 10 may transmit the first direction information to the sound apparatus 20, and the sound apparatus 20 may generate the virtual sound source position information.

Figure 18:
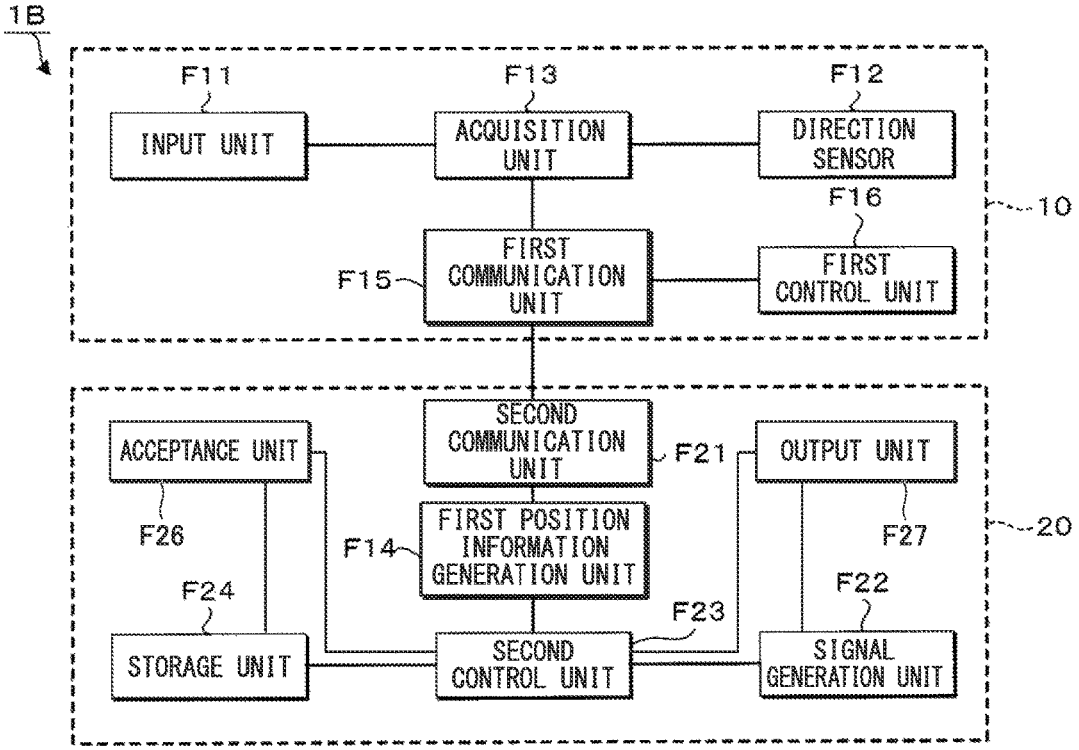
FIG. 18 is a functional block diagram showing a functional configuration of a sound system, according to a first modification example of the present embodiment.

FIG. 18 shows a configuration example of a sound system 1B according to a first modification example. The sound system 1B is configured in the same manner as the sound system 1A shown in FIG. 17, except that the terminal apparatus 10 does not include the first position information generation unit F14, and the sound apparatus 20 includes the first position information generation unit F14.

In the terminal apparatus 10 of the sound system 1B, the second communication unit F21 receives the first direction information transmitted from the terminal apparatus 10. The second control unit F23 supplies the first direction information to the first position information generation unit F14. Moreover, the second control unit F23 generates the virtual sound source position information indicating the position of the virtual sound source based on the listening position information indicating the listening position, the first direction information received from the terminal apparatus 10, and the boundary information indicating the boundary of the space where the virtual sound source is arranged.

According to the first modification example, because the terminal apparatus 10 needs only to generate the first direction information, the processing load on the terminal apparatus 10 can be reduced.

Second Modification Example

In the embodiment described above, the terminal apparatus 10 generates the virtual sound source position information, and transmits the information to the sound apparatus 20. However, the present invention is not limited to this configuration and may be modified as described below. The terminal apparatus 10 generates second direction information indicating the direction of the virtual sound source as seen from the reference position Pref, and transmits the information to the sound apparatus 20. The sound apparatus 20 generates the virtual sound source position information.

Figure 19:
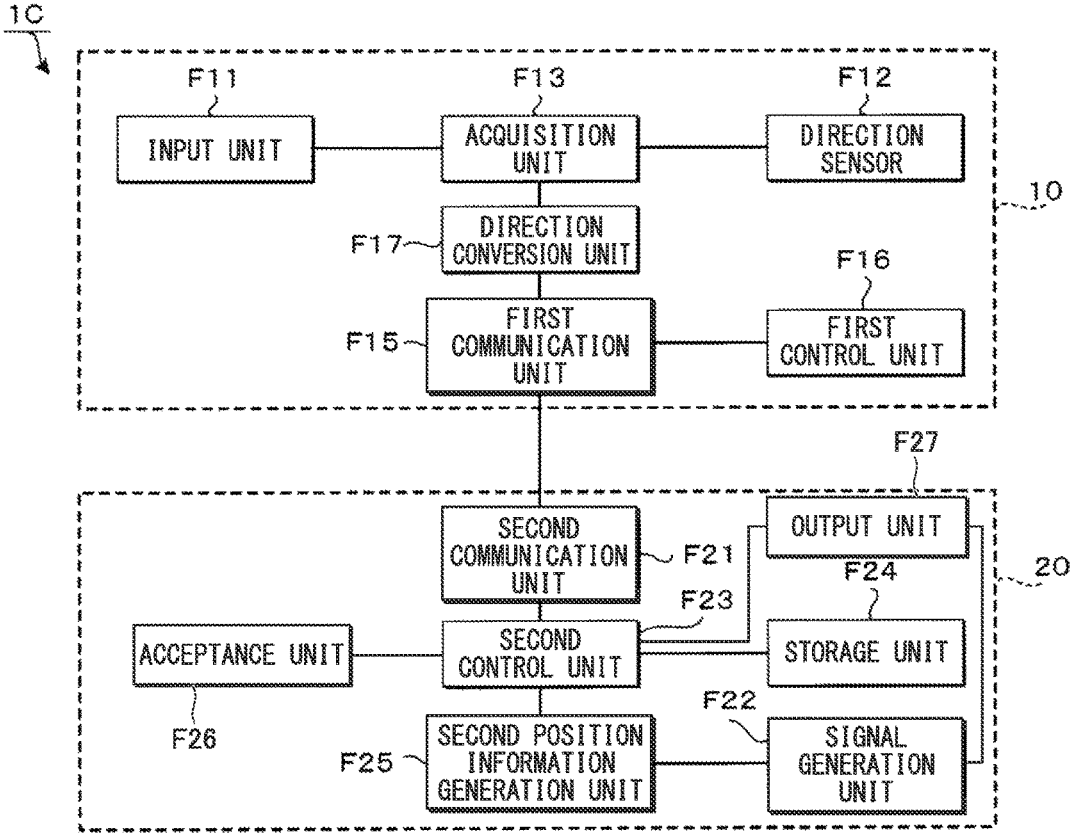
FIG. 19 is a functional block diagram showing a functional configuration of a sound system, according to a second modification example of the present embodiment.

FIG. 19 shows a configuration example of a sound system 1C according to a second modification example. The sound system 1C is configured in the same manner as the sound system 1A shown in FIG. 17, except that the terminal apparatus 10 includes a direction conversion unit F17 instead of the first position information generation unit F14, and the sound apparatus 20 includes a second position information generation unit F25.

In the terminal apparatus 10 of the sound system 1C, the direction conversion unit F17 corresponds to the CPU 100. The direction conversion unit F17 converts the first direction information to the second direction information based on the reference position information indicating the reference position Pref, the listening position information indicating the listening position P, and the boundary information indicating the boundary of the space where the virtual sound source is arranged. As described above, the first direction information indicates a first direction, being the direction of the virtual sound source as seen from the listening position P. The second direction information indicates a second direction, being the direction of the virtual sound source as seen from the reference position Pref.

Specifically, as described above with reference to FIG. 16, the virtual sound source position information is expressed as described below.

$$(xv,yp+\sin[180-\theta a-a\tan\{(ya-yp)/xp\}])$$

The angle θv of the virtual sound source as seen from the reference position Pref is given by the following equation.

$$\theta v=a\tan(yv/xv) \qquad \text{Equation (4)}$$

Because "yv" can be expressed by Equation (3), Equation (4) can be modified as described below.

$$\theta v=a\tan[\{(yp+\sin(180-\theta a-a\tan((ya-yp)/xp))\}/xv] \qquad \text{Equation (5)}$$

In Equation (5), "θv" is the second direction information. "θa" is the first direction information indicating the first direction, being the direction of the virtual sound source as seen from the listening position P. "xv" is the boundary information indicating the boundary of the space where the virtual sound source is arranged.

The first control unit F16 transmits the angle θv, being the second direction information, to the sound apparatus 20 by using the first communication unit F15.

In the sound apparatus 20 of the sound system 1C, the second position information generation unit F25 corresponds to the CPU 210. The second position information generation unit F25 generates the virtual sound source position information indicating the position of the virtual sound source, based on the boundary information, and the second direction information received by using the second communication unit F21.

According to the above-described Equation (4), because "yv/xv=tan θv", "yv=xv·tan θv" is established, where "xv" is given as the boundary information. Consequently, the CPU 210 can generate the virtual sound source position information (xv, yv). The sound apparatus 20 may receive the boundary information from the terminal apparatus 10, or may accept an input of the boundary information from the user A. The boundary information may be information representing a rectangle that surrounds the furthermost position at which the virtual sound source can be arranged in the listening room R, taking the size of the loudspeakers SP1 to SP5 into consideration.

The signal generation unit F22 imparts sound effects to the input audio signals IN1 to IN5 such that sounds are heard at the listening position P as if those sounds came from the virtual sound source, by using the loudspeaker position information and the listening position information in addition to the virtual sound source position information generated by the second position information generation unit F25, to generate the output audio signals OUT1 to OUT5.

According to the second modification example, as in the embodiment described above, when the user A listens to the sound at the listening position P, the user A can arrange the virtual sound source on the boundary of the preset space, by only operating the terminal apparatus 10 toward the first direction, being the arrangement direction of the virtual sound source, at the listening position P. The information transmitted to the sound apparatus 20 is the direction of the virtual sound source as seen from the reference position Pref. The sound apparatus 20 may generate the loudspeaker position information based on the distance from the reference position Pref to the virtual sound source and the arrangement direction of the virtual sound source, and the boundary information may be given as the distance from the reference position Pref as described later. In this case, the program module for generating the virtual sound source position information can be standardized with the program module for generating the loudspeaker position information.

Third Modification Example

In the embodiment described above, explanation has been given, by taking up the wall of the listening room R as an example of the boundary of the space where the virtual sound source is arranged. However, the present invention is not limited to this configuration. A space at the same distance from the reference position Pref may be used as the boundary.

Figure 20:
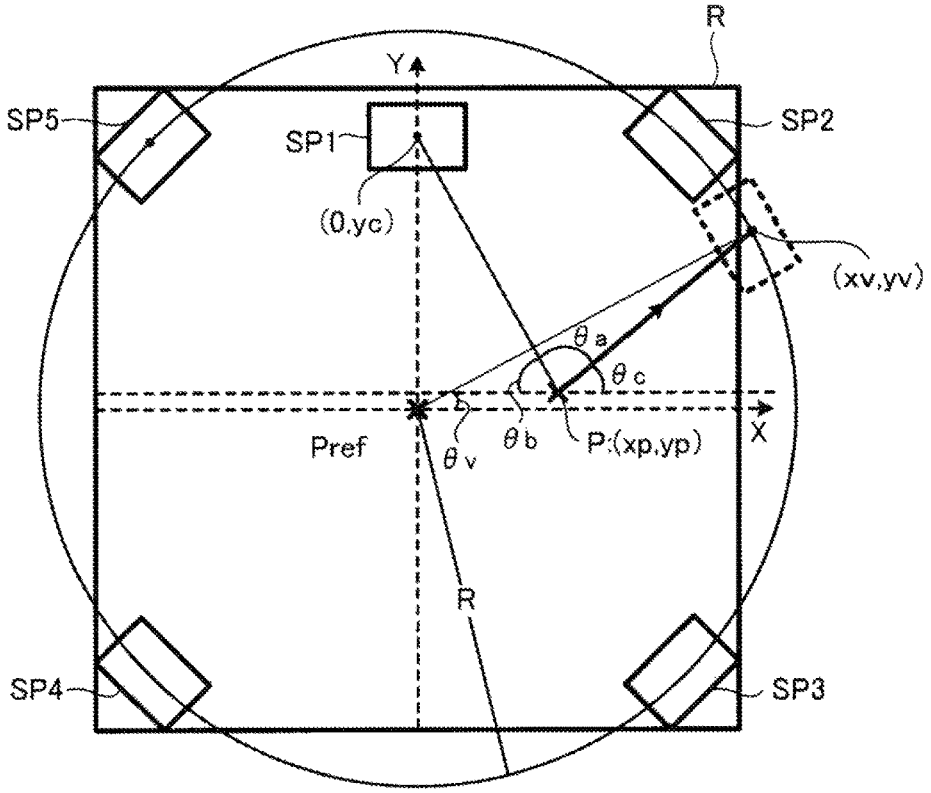
FIG. 20 is a diagram for explaining calculation of a virtual sound source position when a virtual sound source is arranged on a circle equally distant from the reference position, in a third modification example of the present embodiment.

A calculation method of the virtual sound source position V in a case where the virtual sound source is arranged on a circle equally distant from the reference position Pref (that is to say, a circle centered on the reference position Pref) will be described with reference to FIG. 20. With the radius of the circle being expressed by "R", the circle can be expressed by the following Equation (6).

$$R^2=y^2+x^2 \qquad \text{Equation (6)}$$

The straight line passing through the listening position P and the virtual sound source position information (xv, yv) is expressed as "y=tan θc·x+b". Because the straight line passes through the coordinate (xp, yp), if it is substituted in the above-described equation, "b=yp−tan θc·xp" is acquired. As a result, the following Equation (7) is acquired.

$$y=\tan\theta c\cdot x+(yp-\tan\theta c\cdot xp) \qquad \text{Equation (7)}$$

The first position information generation unit F14 of the terminal apparatus 10 can calculate the virtual sound source position information (xv, yv) by solving a simultaneous equation of, for example, Equations (6) and (7).

In the terminal apparatus 10 of the sound system 1B described in the first modification example, the direction conversion unit F17 can convert the angle θa of the first direction to the angle θv of the second direction by using Equation (8).

$$\theta v=a\tan(yv/(R^2-yv^2)^{1/2}) \qquad \text{Equation (8)}$$

Fourth Modification Example

In the embodiment described above, the loudspeaker position information indicating the respective positions of the plurality of loudspeakers SP1 to SP5 is generated by the sound apparatus 20. However, the present invention is not limited to this configuration. The terminal apparatus 10 may generate the loudspeaker position information. In this case, the process described below may be performed. The sound apparatus 20 transmits the distance up to the plurality of loudspeakers SP1 to SP5, to the terminal apparatus 10. The terminal apparatus 10 calculates the loudspeaker position information based on the arrangement direction and the distance of each of the plurality of loudspeakers SP1 to SP5. Moreover, the terminal apparatus 10 transmits the generated loudspeaker position information to the sound apparatus 20.

Fifth Modification Example

According to the embodiment described above, in the measurement of the respective arrangement directions of the plurality of loudspeakers SP1 to SP5, the loudspeaker SP1 is set as the predetermined object, and the angle with respect to the predetermined object is output as a direction. However, the present invention is not limited to this configuration. An arbitrary object arranged in the listening room R may be used as the reference, and the angle with respect to the reference may be measured as the direction.

For example, when a television is arranged in the listening room R, the terminal apparatus 10 may set the television as the object, and may output the angle with respect to the television (object) as the direction.

Sixth Modification Example

Figure 21:
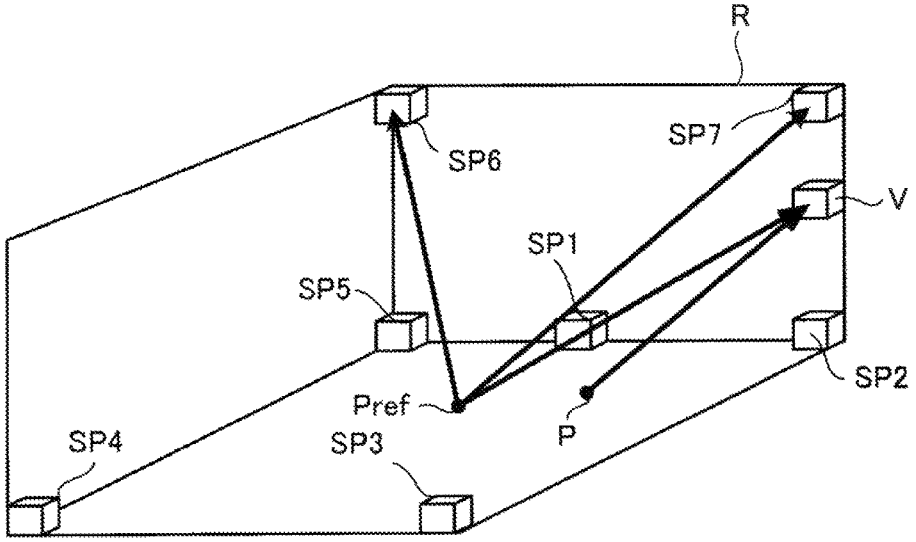
FIG. 21 is a perspective view showing an example in which loudspeakers and a virtual sound source are arranged three-dimensionally, according to a sixth modification example of the present embodiment.

In the embodiment described above, a case where the plurality of loudspeakers SP1 to SP5 and the virtual sound source V are arranged two-dimensionally has been described. However, as shown in FIG. 21, the plurality of loudspeakers SP1 to SP7 and the virtual sound source may be arranged three-dimensionally. In this example, the loudspeaker SP6 is arranged diagonally upward in the front left as seen from the reference position Pref. Moreover, the loudspeaker SP7 is arranged diagonally upward in the front right. Thus, even if the plurality of loudspeakers SP1 to SP7 is arranged three-dimensionally, as the respective arrangement directions of the plurality of loudspeakers SP1 to SP7, the angles of the respective loudspeakers SP2 to SP7 may be measured with the loudspeaker SP1, being the predetermined object, as the reference. The terminal apparatus 10 may calculate the virtual sound source position information based on the first direction of the virtual sound source as seen from the listening position P and the boundary information, and transmit the information to the sound apparatus 20. Alternatively, the terminal apparatus 10 may convert the first direction to the second direction, being the direction of the virtual sound source as seen from the reference position Pref, and transmit the second direction to the sound apparatus 20.

Seventh Modification Example

In the embodiment described above, the virtual sound source position information is generated by operating the input unit F11 in the state with the terminal apparatus 10 being oriented toward the virtual sound source. However, the present invention is not limited to this configuration. The position of the virtual sound source may be specified based on an operation input of tapping a screen of the display unit 130 by the user A.

Figure 22A:
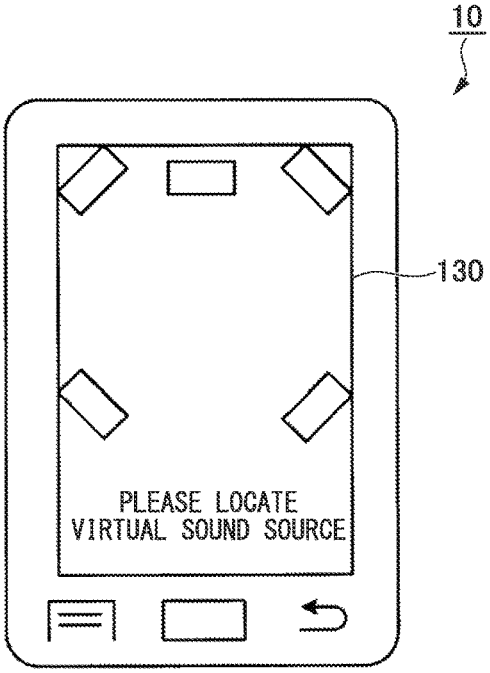
FIG. 22A is an explanatory diagram showing an example in which a virtual sound source is arranged on a screen of a terminal apparatus, according to a seventh modification example of the present embodiment.

A specific example is described with reference to FIG. 22A. As shown in FIG. 22A, the CPU 100 causes the display unit 130 to display a screen displaying the plurality of loudspeakers SP1 to SP5 in the listening room R. The CPU 100 urges the user A to input the position at which the user A wants to arrange the virtual sound source by tapping the screen. In this case, when the user A taps the screen, the CPU 100 generates the virtual sound source position information based on the tap position.

Figure 22B:
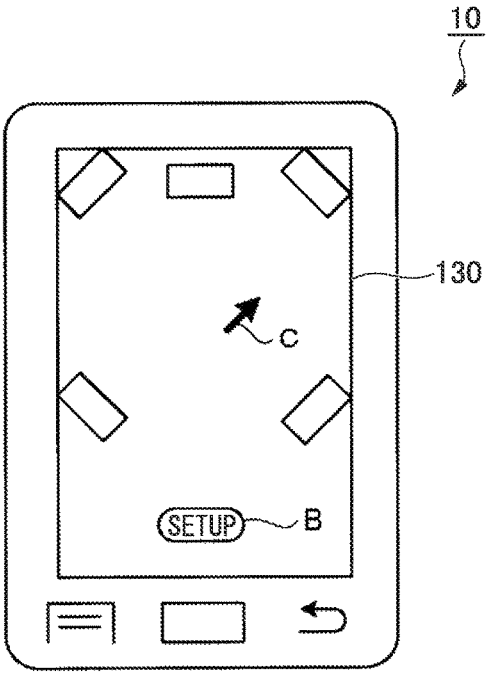
FIG. 22B is an explanatory diagram showing an example in which a virtual sound source is arranged on a screen of a terminal apparatus, according to the seventh modification example of the present embodiment.

Another specific example is described with reference to FIG. 22B. As shown in FIG. 22B, the CPU 100 causes the display unit 130 to display a screen displaying a cursor C. The CPU 100 urges the user A to move the cursor C to the position at which the user A wants to arrange the virtual sound source, and operate the setup key B. In this case, when the user A presses the setup key B, the CPU 100 generates the virtual sound source position information based on the position (and direction) of the cursor C.

Eighth Modification Example

In the embodiment described above, the case is described where the virtual sound source is arranged on the boundary of the arbitrary space that can be specified by the user A, and the shape of the listening room R is an example of the boundary of the space. However, the present invention is not limited to this configuration, and the boundary of the space may be changed arbitrarily as described below. In an eighth modification example, the memory 110 of the terminal apparatus 10 memorizes a specified value representing the shape of the listening room as a value indicating the boundary of the space. The user A operates the terminal apparatus 10 to change the specified value memorized in the memory 110. The boundary of the space is changed with the change of the specified value. For example, when the terminal apparatus 10 detects that the terminal apparatus 10 has been rearranged downward, the terminal apparatus 10 may change the specified value so as to reduce the space, while maintaining similarity of the shape of the space. Moreover, when the terminal apparatus 10 detects that the terminal apparatus 10 has been rearranged upward, the terminal apparatus 10 may change the specified value so as to enlarge the shape, while maintaining similarity of the shape of the space. In this case, the CPU 100 of the terminal apparatus 10 may detect the pitch angle (refer to FIG. 4) of the gyro sensor 151, and reduce or enlarge the space according to an instruction of the user A, and reflect the result thereof in the boundary information. By adopting such an operation system, the user A can enlarge or reduce the shape with a simple operation, while maintaining the similarity of the boundary of the space.

Ninth Modification Example

Figure 23:
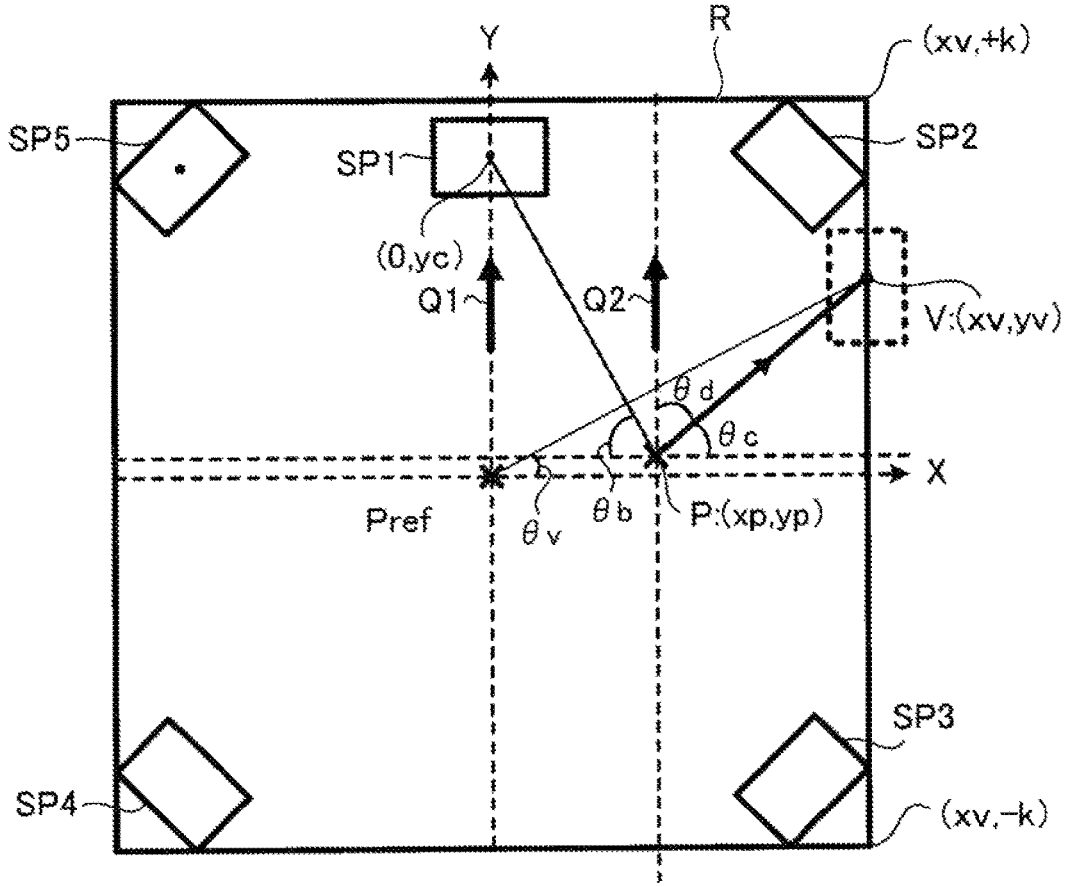
FIG. 23 is a diagram for explaining calculation of virtual sound source position information, according to a ninth modification example of the present embodiment.

In the embodiment described above, at the time of designating the first direction of the virtual sound source by using the terminal apparatus 10, the reference angle is set by performing the setup operation in the state with the terminal apparatus 10 being oriented toward the loudspeaker SP1, being the object, at the listening position (step S31 to step S33 shown in FIG. 13). However, the present invention is not limited to this configuration. Any method can be adopted so long as the reference angle can be set. For example, as shown in FIG. 23, at the listening position P, the reference angle may be set by performing the setup operation by the user A in the state with the terminal apparatus 10 being oriented toward a direction Q2 parallel to a direction Q1 in which the user A sees the predetermined object at the reference position Pref.

In this case, when the measured angle is expressed as "θd", because "θc=90−θd", "yv" is expressed as described below.

$$yv = \sin\theta c + yp$$

$$= yp + \sin(90 - \theta d)$$

Consequently, the virtual sound source position information indicating the virtual sound source position V is expressed as "(xv, yp+sin(90−θd))".

According to the embodiments described above, at least one of the listening position information and the boundary information may be memorized in the memory of the terminal apparatus, or may be acquired from an external device such as the sound apparatus. The "space" may be expressed three-dimensionally in which a height direction is added to the horizontal direction, or may be expressed two-dimensionally in the horizontal direction excluding the height direction. The "arbitrary space that can be specified by the user" may be the shape of the listening room. In the case where the listening room is a space of 4 meter square, the "arbitrary space that can be specified by the user" may be an arbitrary space that the user specifies inside the listening room, for example, may be a space of 3 meter square. The "arbitrary space that can be specified by the user" may be a sphere or a circle having an arbitrary radius centering on the reference position. If the "arbitrary space that can be specified by the user" is the shape of the listening room, the "boundary of the space" may be the wall of the listening room.

INDUSTRIAL APPLICABILITY

The present invention is applicable to a program used for a terminal apparatus, a sound apparatus, a sound system, and a method used for the sound apparatus.

REFERENCE SYMBOLS

1A, 1B, 1C Sound system
10 Terminal apparatus
20 Sound apparatus
F11 Input unit
F12 Direction sensor
F13 Acquisition unit
F14 First position information generation unit
F15 First communication unit
F16 First control unit
F17 Direction conversion unit
F21 Second communication unit
F22 Signal generation unit
F23 Second control unit
F24 Storage unit
F25 Second position information generation unit
F26 Acceptance unit
F27 Output unit

The invention claimed is:

1. A non-transitory computer-readable recording medium storing a program for a terminal apparatus, the terminal apparatus including an input interface, a direction sensor, a communication interface and a processor, the input interface receiving from a user an instruction in a state with the terminal apparatus being arranged at a listening position, the instruction indicating that the terminal apparatus is oriented toward a first direction, the first direction being a direction in which a virtual sound source is arranged, the direction sensor detecting a direction in which the terminal apparatus is oriented, the communication interface performing communication with a sound apparatus, the program causing the processor to execute:

acquiring from the direction sensor first direction information indicating the first direction, in response to the input interface receiving the instruction;

generating virtual sound source position information based on listening position information, the first direction information and boundary information, the listening position information indicating the listening position, the boundary information indicating a boundary of a space where the virtual sound source is arranged, the virtual sound source position information indicating a position of the virtual sound source on the boundary; and transmitting the virtual sound source position information to the sound apparatus, by using the communication interface; and wherein, based on the listening position information and the transmitted virtual sound source position information, the sound apparatus imparts a sound effect to an input audio signal such that a sound is heard at the listening position as if the sound comes from the virtual sound source in order to generate an output signal and output audio signal to outside.

2. The recording medium according to claim 1, wherein the program causes the processor to execute setting an object direction as a reference, in response to the input interface receiving a first instruction, the first instruction indicating that the terminal apparatus is oriented toward the object direction, the object direction being a direction toward an object.

3. The recording medium according to claim 2, wherein the program causes the processor to execute acquiring, as the first direction information, an angle formed by the object direction and the first direction.

4. The recording medium according to claim 1, wherein the program causes the processor to execute converting the first direction information, from information indicating a direction in which the virtual sound source is arranged as seen from the listening position, to information indicating a direction in which the virtual sound source is arranged as seen from a reference position, the reference position being a front of one of a plurality of loudspeakers.

5. The recording medium according to claim 1, wherein the program causes the processor to execute computing, as the virtual sound source information, a coordinate of the virtual sound source with a reference position as an origin, the reference position being a front of one of a plurality of loudspeakers.

6. A sound apparatus comprising:

at least one processor for executing stored instructions to:

receive an input of an input audio signal from outside;

receive from a terminal apparatus first direction information indicating a first direction, the first direction being a direction in which a virtual sound source is arranged;

generate virtual sound source position information based on listening position information, the first direction information and boundary information, the listening position information indicating a listening position, the boundary information indicating a boundary of a space where the virtual sound source is arranged, the virtual sound source position information indicating a position of the virtual sound source on the boundary;

impart, based on loudspeaker position information, the listening position information and the virtual sound source position information, a sound effect to the input audio signal such that a sound is heard at the listening position as if the sound comes from the virtual sound source, to generate an output audio signal, the loudspeaker position information indicating positions of a plurality of loudspeakers; and circuitry that outputs the output audio signal to outside.

7. The sound apparatus according to claim 6, wherein the at least one processor computes, as the virtual sound source information, a coordinate of the virtual sound source with a reference position as an origin, the reference position being a front of one of the plurality of loudspeakers.

8. A sound system comprising a sound apparatus and a terminal apparatus, wherein the terminal apparatus includes:

an input interface that receives from a user an instruction in a state with the terminal apparatus being arranged at a listening position, the instruction indicating that the terminal apparatus is oriented toward a first direction, the first direction being a direction in which a virtual sound source is arranged;

a direction sensor that detects a direction in which the terminal apparatus is oriented;

at least one first processor for executing instructions to:

acquire from the direction sensor first direction information indicating the first direction, in response to the input interface receiving the instruction;

generate virtual sound source position information based on listening position information, the first direction information and boundary information, the listening position information indicating the listening position, the boundary information indicating a boundary of a space where the virtual sound source is arranged, the virtual sound source position information indicating a position of the virtual sound source on the boundary; and a first communication interface that transmits the virtual sound source position information to the sound apparatus, and the sound apparatus includes:

at least one second processor for executing stored instructions to:

receives an input of an input audio signal from outside;

impart, based on loudspeaker position information, the listening position information and the virtual sound source position information, a sound effect to the input audio signal such that a sound is heard at the listening position as if the sound comes from the virtual sound source, to generate an output audio signal, the loudspeaker position information indicating positions of a plurality of loudspeakers; and a second communication interface that receives the virtual sound source position information from the terminal apparatus;

circuitry that outputs the output audio signal to outside.

9. The sound system according to claim 8, wherein the input interface receive from a user a first instruction indicating that the terminal apparatus is oriented toward an object direction, the object direction being a direction toward an object, and the at least one first processor sets the object direction as a reference, in response to the input interface receiving the first instruction.

10. The sound system according to claim 9, wherein the at least one first processor acquires, as the first direction information, an angle formed by the object direction and the first direction.

11. The sound system according to claim 8, wherein the terminal apparatus further includes a direction conversion unit that converts the first direction information, from information indicating a direction in which the virtual sound source is arranged as seen from the listening position, to information indicating a direction in which the virtual sound source is arranged as seen from a reference position, the reference position being a front of one of the plurality of loudspeakers.

12. The sound system according to claim 8, wherein the at least one first processor computes, as the virtual sound source information, a coordinate of the virtual sound source with a reference position as an origin, the reference position being a front of one of the plurality of loudspeakers.

13. A method comprising:

receiving an input of an input audio signal from outside;

receiving from a terminal apparatus first direction information indicating a first direction, the first direction being a direction in which a virtual sound source is arranged;

generating virtual sound source position information based on listening position information, the first direction information and boundary information, the listening position information indicating a listening position, the boundary information indicating a boundary of a space where the virtual sound source is arranged, the virtual sound source position information indicating a position of the virtual sound source on the boundary;

imparting, based on loudspeaker position information, the listening position information and the virtual sound source position information, a sound effect to the input audio signal such that a sound is heard at the listening position as if the sound comes from the virtual sound source, to generate an output audio signal, the loudspeaker position information indicating positions of a plurality of loudspeakers; and outputting the output audio signal to outside.

14. The method according to claim 13, wherein a coordinate of the virtual sound source is computed as the virtual sound source information, with a reference position as an origin, the reference position being a front of one of the plurality of loudspeakers.

* * * * *